US008615908B2

(12) United States Patent
Collinson et al.

(10) Patent No.: US 8,615,908 B2
(45) Date of Patent: Dec. 31, 2013

(54) HAND-HELD STEAM APPLIANCES

(75) Inventors: Marc Gibson Collinson, Lonan (IM); Nicholas Edward Gibbs, Baldrine (IM); Steven Anthony Ashton, Agneash (IM); Vincent Joseph Garvey, Colby (IM)

(73) Assignee: Strix Limited, Ronaldsway (IM)

( * ) Notice: Subject to any disclaimer, the term of this patent is extended or adjusted under 35 U.S.C. 154(b) by 21 days.

(21) Appl. No.: 13/148,244

(22) PCT Filed: Feb. 4, 2010

(86) PCT No.: PCT/GB2010/000212

§ 371 (c)(1),
(2), (4) Date: Nov. 21, 2011

(87) PCT Pub. No.: WO2010/089565

PCT Pub. Date: Aug. 12, 2010

(65) Prior Publication Data

US 2012/0060396 A1 Mar. 15, 2012

(30) Foreign Application Priority Data

Feb. 5, 2009 (GB) ..... 0901855.7

(51) Int. Cl.
*D06F 75/40* (2006.01)
*D06F 79/02* (2006.01)

(52) U.S. Cl.
USPC ..... 38/77.6

(58) Field of Classification Search
USPC ..... 38/79, 93, 88, 96, 142; 219/259, 246; 248/117.1–117.7; D32/73
See application file for complete search history.

(56) References Cited

U.S. PATENT DOCUMENTS

| | | | |
|---|---|---|---|
| 2,871,587 | A | 2/1959 | Jepson |
| 3,742,629 | A | 7/1973 | Plasko |
| 3,811,208 | A | 5/1974 | Vieceli et al. |
| 3,889,406 | A | 6/1975 | Chivers et al. |
| 4,078,525 | A | 3/1978 | Chiba |
| 4,571,483 | A | 2/1986 | Fathi |
| 4,784,616 | A | 11/1988 | Zimmermann |
| 4,815,992 | A | 3/1989 | Aranzabal |
| 4,910,895 | A | 3/1990 | Rethmeier et al. |
| 4,939,342 | A | 7/1990 | Frens et al. |
| 5,060,406 | A | 10/1991 | Verweij et al. |
| 5,074,066 | A | 12/1991 | Sakano et al. |
| 5,142,124 | A | 8/1992 | Driessen |
| 5,189,726 | A | 2/1993 | Pan |
| 5,307,573 | A | 5/1994 | Watkins |

(Continued)

FOREIGN PATENT DOCUMENTS

| | | |
|---|---|---|
| DE | 3006783 | 8/1981 |
| EP | 0315915 | 5/1989 |

(Continued)

*Primary Examiner* — Ismael Izaguirre
(74) *Attorney, Agent, or Firm* — O'Shea Getz P.C.

(57) ABSTRACT

A steam generating appliance such as an electric iron comprises a base unit and a hand-held mobile unit which can be releasably coupled to the base unit. The base unit comprises a reservoir for water and a pump for pumping water from the reservoir into the mobile unit when the mobile unit is coupled to the base unit. The mobile unit comprises a boiler and an on-board reservoir for water, wherein the on-board reservoir is adapted to store water received from the base unit under pressure and to deliver the water to the boiler under the control of a user-operable valve.

36 Claims, 14 Drawing Sheets

(56) References Cited

U.S. PATENT DOCUMENTS

| | | | | |
|---|---|---|---|---|
| 5,315,773 | A * | 5/1994 | Iwami et al. | 38/77.6 |
| 5,341,585 | A | 8/1994 | Stephan et al. | |
| 5,390,432 | A * | 2/1995 | Boulud et al. | 38/77.83 |
| 5,526,594 | A | 6/1996 | Fourny et al. | |
| 5,526,596 | A | 6/1996 | Bitzel et al. | |
| 5,581,919 | A | 12/1996 | Torma et al. | |
| 5,592,764 | A | 1/1997 | Boulud et al. | |
| 5,613,309 | A | 3/1997 | Amsel et al. | |
| 5,638,622 | A | 6/1997 | Hohn | |
| 5,802,749 | A | 9/1998 | Barmentlo et al. | |
| 5,832,639 | A * | 11/1998 | Muncan | 38/77.6 |
| 5,941,619 | A | 8/1999 | Stieben et al. | |
| 5,979,089 | A | 11/1999 | Bouleau et al. | |
| 6,061,935 | A * | 5/2000 | Lee | 38/77.6 |
| 6,176,026 | B1 | 1/2001 | Leung | |
| 6,249,996 | B1 | 6/2001 | Dorber et al. | |
| 6,640,472 | B1 | 11/2003 | Wu | |
| 6,684,539 | B2 * | 2/2004 | Boulud et al. | 38/77.83 |
| 7,086,186 | B2 * | 8/2006 | Kobayashi et al. | 38/96 |
| 7,114,274 | B2 | 10/2006 | Kobayashi et al. | |
| 2001/0032599 | A1 | 10/2001 | Fischer et al. | |
| 2001/0034959 | A1 | 11/2001 | Horn et al. | |
| 2002/0020086 | A1 | 2/2002 | Ostermaie | |
| 2002/0029498 | A1 | 3/2002 | Harrison et al. | |
| 2002/0157288 | A1 | 10/2002 | Valiyambath | |
| 2003/0094445 | A1 | 5/2003 | Alday | |
| 2003/0221342 | A1 | 12/2003 | Milanese | |
| 2004/0217101 | A1 | 11/2004 | Choo | |
| 2005/0040153 | A1 | 2/2005 | Albandoz Ruiz de Ocenda et al. | |
| 2006/0210784 | A1 | 9/2006 | Shi et al. | |
| 2008/0040954 | A1 | 2/2008 | Yu et al. | |
| 2008/0052971 | A1 | 3/2008 | Giovalle et al. | |
| 2008/0189992 | A1 | 8/2008 | Valiyambath Krishnan et al. | |
| 2008/0229628 | A1 | 9/2008 | Valiyambath et al. | |
| 2009/0000161 | A1 | 1/2009 | Weber et al. | |
| 2010/0107457 | A1 | 5/2010 | Nathamuni Balaji et al. | |

FOREIGN PATENT DOCUMENTS

| | | |
|---|---|---|
| EP | 0339233 | 11/1989 |
| EP | 0588163 | 3/1994 |
| EP | 0863246 | 9/1998 |
| EP | 0922426 | 6/1999 |
| EP | 1835067 | 9/2007 |
| FR | 2523164 | 9/1983 |
| FR | 2583792 | 12/1986 |
| FR | 2853671 | 10/2004 |
| GB | 491759 | 9/1938 |
| GB | 704921 | 3/1954 |
| GB | 763786 | 12/1956 |
| GB | 772095 | 4/1957 |
| GB | 991209 | 5/1965 |
| GB | 992263 | 5/1965 |
| GB | 1085220 | 9/1967 |
| GB | 1141318 | 1/1969 |
| GB | 1208192 | 10/1970 |
| GB | 2077624 | 12/1981 |
| GB | 2113723 | 8/1983 |
| GB | 2308135 | 6/1997 |
| GB | 2342101 | 4/2000 |
| JP | 1135399 | 5/1989 |
| JP | 2305600 | 12/1990 |
| JP | 3118100 | 4/1991 |
| JP | 3254799 | 11/1991 |
| JP | 4006000 | 1/1992 |
| JP | 4073099 | 3/1992 |
| JP | 4097798 | 3/1992 |
| JP | 04122393 | 4/1992 |
| JP | 4122395 | 4/1992 |
| JP | 4132600 | 5/1992 |
| JP | 04200596 | 7/1992 |
| JP | 6327900 | 11/1994 |
| JP | 7060000 | 3/1995 |
| JP | 7185198 | 7/1995 |
| JP | 7236798 | 9/1995 |
| JP | 7236800 | 9/1995 |
| JP | 2000202196 | 7/2000 |
| JP | 2006034313 | 2/2006 |
| JP | 2006136605 | 6/2006 |
| WO | 0153596 | 7/2001 |
| WO | 2004003793 | 5/2004 |
| WO | 2004085732 | 10/2004 |
| WO | 2008075308 | 6/2008 |

* cited by examiner 118
122
116

120
122
118

116'
122
124

124

HAND-HELD STEAM APPLIANCES

This application is entitled to the benefit of, and incorporates by reference essential subject matter disclosed in PCT Application No. PCT/GB2010/000212 filed on Feb. 4, 2010, which claims priority to Great Britain Application No. 0901855.7 filed Feb. 5, 2009. It is also related to PCT Application No. PCT/GB2010/000206 filed on Feb. 4, 2010.

BACKGROUND OF THE INVENTION

1. Technical Field

This invention relates to the electric generation of steam for use in domestic irons, steam cleaners, wallpaper strippers and other hand-held steam generating appliances.

2. Background Information

Domestic steam irons have been around for a long time. They comprise a sole plate which is flat and intended to contact the item to be ironed and which is normally heated by means of a sheathed electrical resistance heater mounted to or embedded in the upper side of the sole plate. Traditionally, such irons which are designed to produce steam in order to improve ironing have a semi-closed cavity formed on the upper face of the sole plate and into which water is dripped from an on-board reservoir to produce steam which is then allowed to escape onto the clothes by means of a series of apertures formed in the sole plate. These are commonly known as vented steam irons. They are relatively simple and inexpensive to implement which has made them very popular. However, the steam produced is at very low pressure (essentially ambient pressure) and cannot be produced very quickly, making it relatively ineffective.

At the other end of the market, are professional or semi-professional steam ironing systems in which high pressure steam (e.g. of the order of 3 to 5 bar) is continuously produced in a static base station incorporating a large water reservoir which can then be fed, on demand, to the user's hand-held unit by means of an umbilical cord. These are commonly known as pressurized steam generator irons. They deliver a very high performance but are very expensive and tend to account therefore only for a very small proportion of the market.

More recently there have been proposals, some of which have been commercialized, which seek to bridge the gap between the two extremes outlined above, although these have tended to carry their own drawbacks. For example, it has been proposed to provide a boiler in a base unit, separate from the iron, which is fed by pumping water into it from a reservoir in the base station. The main disadvantage with these arrangements, commonly known as instantaneous steam generator irons, is that there is in fact a significant time lag (of the order of 10 seconds) between the user pressing a button to demand steam and the steam actually being produced and conveyed to the iron. This significantly limits user acceptance, even though higher steam flow rates than vented steam irons can be achieved when the steam is eventually delivered.

It is an aim of the present invention to provide an improved arrangement for generating steam on demand which can be used in steam irons, but also in other devices employing steam, such as steam cleaners, wallpaper strippers, other hand-held steam generating appliances etc.

SUMMARY OF THE DISCLOSURE

When viewed from a first aspect the invention provides a steam generating appliance comprising a base unit and a hand-held mobile unit which can be releasably coupled to the base unit, wherein the base unit comprises; a base reservoir for water; and a pump for pumping water from the base reservoir into the mobile unit when the mobile unit is coupled to the base unit; and wherein the mobile unit comprises: a boiler, and an on-board reservoir adapted to store water received from the base unit under pressure and to deliver the water to the boiler under the control of a user-operable valve.

Thus it will be seen by those skilled in the art that in accordance with the invention steam can be produced "on demand" in a mobile unit by a user opening the valve to admit water into the boiler, with very little time lag because the water is stored on the mobile unit—i.e. very close to the boiler and is stored under pressure so it will quickly enter the boiler upon the valve being opened.

The appliance could be any portable appliance for generating steam such as a steam iron, steam cleaner, wallpaper stripper etc. Where the appliance is an iron it preferably comprises a sole plate heated by an electric heater which is independent of the boiler.

The pump could be arranged to be operated only when needed—e.g. when the water pressure falls below a threshold level or when the mobile unit is coupled to the base unit. However in one set of embodiments the pump is arranged to operate continuously whilst the appliance is switched on. This ensures that pressure is maintained for minimizing the amount of time either to refill the on-board reservoir (for a cordless appliance or one operated in cordless mode) or to deliver water to the boiler (for an appliance operated in corded mode). Preferably means are provided for diverting pumped water back to the base reservoir when delivery of water to the mobile unit is not required to prevent the pump stalling or drawing excessive current.

Although the boiler will typically be thermostatically controlled, when the mobile unit is coupled to the base unit the boiler is preferably arranged such that it is allowed to reach a higher operating temperature when there is no water flow (i.e. when the valve is closed) than when the valve is opened and water is flowing. This means that the boiler can store additional thermal energy in its thermal mass, further reducing the time to produce the first shot of steam after the valve is opened because the surge of water can then be heated more rapidly and also maximizing the time for which it can operate decoupled from the base when it is not being heated.

The on-board reservoir could be arranged to supply water in several different ways. For example, it might simply be disposed in an upper part of the appliance (with respect to the orientation in which the appliance is normally meant to be used) such that the water is supplied under hydrostatic force. Another alternative would be to provide some form of pump, although clearly this would bring with it the disadvantage of requiring a source of energy. In a preferred set of embodiments, the on-board reservoir is pressurized. This could for example be achieved by means of a compressed air chamber but preferably the on-board reservoir is elastically charged. In one set of embodiments, the on-board reservoir is acted upon by a resiliently mounted piston. In another set of embodiments, the on-board reservoir has one or more expandable walls. The walls themselves could be elastically expandable and/or could expand into an elastically compressible surrounding medium. In a set of embodiments, the on-board reservoir comprises a bladder, preferably an elastically expandable bladder, which is arranged within an appliance to expand into a space within the appliance. This is particularly beneficial as the bladder can expand into an irregularly shaped space thus making it easier to accommodate within an appliance without compromising the external design.

Indeed, this concept is considered to be novel and inventive in its own right and thus when viewed from a second aspect the invention provides a cordless electrical mobile appliance comprising a water reservoir for storing water under pressure, the water reservoir comprising an expandable bladder arranged such that pressure is applied to the water therein when expanded.

Any of the essential or preferred features of the first aspect of the invention set out above may be applied to this invention. Thus in one set of embodiments the appliance comprises a boiler and so could be a steam iron, steam cleaner, wallpaper stripper or any other hand-held steam-generating appliance. Similarly, in a preferred set of embodiments the appliance is arranged such that the on-board reservoir can be refilled from a corresponding base station.

The capacity of the on-board reservoir, i.e. that provided on the mobile unit, can be designed to give a certain period of use off the base before it must be replenished. Conveniently, this time is related to the time taken for the boiler and/or the sole plate in the case of an iron to fall below a certain minimum temperature for useful operation. Preferably the capacity of the on-board reservoir is sufficient to provide the water to generate steam for more than 10 seconds, preferably more than 15 seconds, preferably more than 20 seconds. In some embodiments enough water is stored for 30 seconds or more of steam.

Preferably the boiler comprises a water inlet, an electric heater, a steam outlet and an evaporation space bounded by at least one surface in thermal contact with the heater, wherein the evaporation space is configured to present an expanding cross-sectional area in a direction away from the water inlet. This corresponds to an increasing internal volume in the evaporation space and a corresponding increase in surface area during the advancement and a corresponding rise in temperature of the water and steam. In accordance with such arrangements, the evaporation space can start off relatively small to give good intimate contact between the water and the heated surface(s) of the evaporation space to give efficient evaporation of the water, whilst at the same time allowing the steam so generated to expand into the increasing volume as it flows away from the water inlet e.g. to an outlet.

In some embodiments the evaporation space is very shallow to maximise the surface area over which the water is spread to enhance the efficiency of steam generation. In an exemplary set of embodiments, the height of the evaporation space is narrow enough to prevent drops from forming—e.g. less than 3 mm. In some embodiments the evaporation space has a constant, preferably shallow height. In some possible implementations of the boiler, the evaporation space is formed between two similarly shaped surfaces in close proximity to one another. The separation of the surfaces provides the height of the evaporation space and thus in a set of preferred embodiments they are separated by a gap of less than 3 mm.

Clearly when the height of the evaporation space is constant, the expanding cross-section is provided by an increasing width to give the recited increase in the cross-sectional area of the evaporation space in a direction away from the water inlet. In some example embodiments, the evaporation surface is convex, concave or conical. Other substantially two or three dimensional forms such as fans, deltas, hemispheres, parabolas, prisms, pyramids and other suitable forms can be employed to provide the required increasing volume and surface area. Of course, other, more complex, shapes could be used to give the same effect, both internally to enhance surface area and so evaporation efficiency and externally to minimize the space required for the boiler in the appliance. Equally however the evaporation space could simply comprise an open chamber—in other words it is not essential for it to be narrow.

The heated surface bounding the evaporation space (hereinafter referred to as "the evaporation surface") is preferably non-planar. This facilitates maximising the surface area available in a given volume occupied by the boiler within the appliance. In a set of preferred embodiments, the surface area of the evaporation surface (measured prior to the application of any surface enhancing coating) is more than 1.5 times the maximum planar projection of the surface (i.e. the footprint), more preferably greater than 1.75 times, more preferably greater than twice.

The evaporation space could be empty until it is filled with water/steam, although in one set of embodiments a lattice or mesh structure is provided. In some circumstances this can enhance the efficiency of steam generation by increasing the effective area which is heated and can also help to reduce the Leidenfrost effect (whereby small droplets of water surrounded by an insulating layer of steam are formed when water comes into contact with a very hot surface). In an exemplary set of embodiments, a woven metal mesh is located within the evaporation space. The mesh structure could be lightly compressed against the evaporation surface, e.g. by being trapped between two confronting surfaces as previously mentioned so that the extremities of the mesh's major surfaces, those created by the alternating under and over relationship of the mesh's woven elements, contact the evaporation surface and the confronting surface in a corresponding alternating arrangement. Filling the evaporation space with a lattice or mesh can help to restrict the flow of water particles, but allow the freer passage of steam, so increasing the evaporation efficiency of the boiler. In one set of embodiments a woven stainless steel mesh or meshes is employed which is advantageously corrosion resistant. However other configurations can provide a similar advantageous effect, e.g. an expanded mesh, a perforated material, a fibrous material etc.

Additionally, or alternatively, the evaporation surface could be provided with a texture, structure or coating to increase its surface area at a microscopic level and/or to mitigate the Leidenfrost effect. For example the surface could comprise steps, tessellations or texture creating a myriad of channels or small structures for increased surface area and turbulence to flow within the evaporation space.

Preferably the evaporation surface is hydrophilic, at least at its normal operating temperature. In an exemplary set of embodiments the normal operating temperature is greater than 180° C. This might be a natural characteristic of the material used for the evaporation surface, it might be achieved or enhanced by a suitable surface treatment and/or it might be achieved or enhanced by a suitable heat resistant coating material. Where the evaporation surface is made hydrophilic by a surface treatment or coating the treated or coated surface should be hydrophilic at a temperature at which the Leidenfrost would otherwise occur on the untreated or uncoated surface.

In a set of embodiments the evaporation surface is coated with a coating comprising zeolite particulates. Preferably said zeolite particles are of a nano and micro scale. In a set of embodiments the coating comprises aluminosilicate particles. In an exemplary set of embodiments the particles have the CAS number 1318-02-01 or similar Preferably such a coating comprises a binder which acts as a carrier medium to facilitate the application as a thin film between 3 microns to 100 microns in thickness but more preferably between 3 microns and 50 microns in thickness. The binder is preferably formulated not to saturate the structure of the zeolite particles and to facilitate a functional film layer with micro-porous properties, improving surface wetting and exhibiting minimal surface tension in contact with water.

Prior to drying or curing to form the functional coating, the zeolite particulates are held in suspension within the binder. Upon hardening to form the functional coating the zeolite particles are thereafter encapsulated or partially encapsulated by the binder to create a nano and or micro scale structured open cell syntactic matrix where the zeolite particulates act as scaffolds with interlinking nano and or micro scale voids creating a partially open and partially closed cell structure. Prior to the application of the functional coating, the internal surfaces of the boiler may be prepared via surface roughening and degreasing, where the surface is abraded and a defined texture results to assist in mechanical bonding of the functional coating to the prepared surface but also to further impart a texture. Such a texture can influence the heat transfer surface of the functional coating. The preferred surface roughening method would be high pressure grit blasting or blasting with any other suitable substrate to create the preferred finish however other suitable methods may be employed.

In a set of embodiments, at least part of the evaporation space is configured so as to present an interrupted flow path. Advantageously, such a structure could be provided at least in a portion nearest to an exit of the evaporation space, i.e. furthest from the water inlet. Such arrangements have been found to enhance the evaporation of water which has not been evaporated and also to physically separate unevaporated droplets of water from the steam. The Applicant has found that a similar effect can be found by throttling or otherwise restricting the flow of steam.

The evaporation space may of course have more than one evaporation surface. This might be the case as a result of the distribution of the heating element, the provision of multiple heating elements, or simply by the close thermal connection between a surface which is directly heated and another surface.

In a set of preferred embodiments the boiler is configured to produce super-heated steam. In some preferred embodiments the boiler has a temperature of between 100 and 500° C., more preferably between 105 and 380° C. Preferably the internal steam pressure generated within the boiler should not be greater than that of the water pressure entering it, or water will be prevented from entering the device, resulting in a subsequent drop in steam flow rate and unwanted fluctuation in steam output.

Steam may simply be allowed to leave the boiler once it has passed through the evaporation space. However, in a set of preferred embodiments the boiler comprises means for collecting the steam. This allows it, for example, to be channeled into one or more pipes for delivering it to the steam outlet(s) of an appliance on which the boiler is provided. Preferably the means for collecting steam comprises means for trapping unevaporated droplets of water. For example this might be a protruding outlet tube encouraging steam channeled by the walls of the chamber to undergo a change of direction leading to expulsion of entrained droplets.

In a set of preferred embodiments the boiler is divided into the evaporation space and a steam collection space. In a set of embodiments the boiler is divided by an intermediate member provided in the chamber of the boiler. Preferably the intermediate member provides one of the surfaces defining the evaporation space.

A boiler in accordance with the aspect of the invention set out above may usefully be used for the continuous generation of steam. However, it is particularly beneficial for appliances where steam is required "on demand" since the features described above, at least in their preferred embodiments, allow the very rapid production of steam from when water first enters the water inlet as compared, for example, with a more traditional boiler in which a heating element is used to heat a body of water. An important factor in achieving this effect is to supply water to the boiler under pressure and thus a particularly preferred set of embodiments has a boiler of the kind described above, or indeed one which only has some of the features set out, which might include the feature of expanding cross-sectional area, in an appliance comprising means for supplying pressurized water to the water inlet of the boiler. As previously mentioned, such an appliance could, for example comprise an electric iron, a steam cleaner, wallpaper stripper or any other hand-held steam generating appliance. The means for pressurizing water could be any of those discussed above or indeed any other. The pressure of the water supply is preferably greater than 0.5 bar, e.g. more than 1 bar and might be up to 3 bar or more.

Where the boiler is to be used to produce steam "on demand" it is beneficial, in order to minimize the initial delay between filling it with water and producing steam, that when it does not contain water, it is allowed to increase in temperature and therefore store thermal energy which can be used to heat the initial charge of water to boiling as rapidly as possible. In a set of preferred embodiments, the useable energy which the boiler is adapted to store, that is the amount of heat energy available to generate steam, is more than 20 kilojoules, more preferably greater than 35 kilojoules and more preferably greater than 50 kilojoules.

In accordance with the invention there is provided a mobile appliance and a base unit. For many electrical appliances, it is convenient for a mobile unit to have a cordless electrical connection to a base unit. This might, for example, be because the mobile unit includes a battery which only needs periodic recharging when placed on the base unit, or it could be that, for example in the case of a kettle or coffee maker, electrical power is only needed for a short time and the cordless connection allows the appliance to be moved to where it is needed.

In the case of irons, although there are many cordless irons available and these have obvious convenience advantages, there is a perception across a significant part of the market that cordless irons, particularly cordless steam irons, have a substantially inferior performance as compared to corded versions since by definition heat cannot be supplied while the iron is being used. The Applicant has recognized that there are advantages and disadvantages both ways. It has therefore devised an arrangement which seeks to achieve some of the advantages of both arrangements. In accordance with some embodiments of the invention therefore there is provided an adaptor for supplying electrical power to a mobile electrical appliance, said adaptor being operable in a first, corded mode in which it is secured to the appliance to permit electrical power and water to be supplied while the appliance is being used; or in a second, cordless mode in which it is secured to a base unit such that electrical and water connection between the adaptor and the appliance can be made by placing the appliance on or against the base unit; and broken by lifting or moving the appliance away from the base unit.

Thus it will be seen that in accordance with these embodiments of the invention, a mobile appliance may be operated either in a corded or in a cordless mode depending upon the requirements of the user. For example in the context of an electric iron, if a user wished to carry out a series of light ironing tasks, he or she could conveniently use the iron in the cordless mode and replace it on the adaptor to reheat it and replenish the on-board reservoir between garments. Alternatively if a heavy ironing task arose, perhaps requiring a lot of steam, the user can attach the adaptor to the iron and enjoy the benefits of the ability to supply power and water while the iron is actually being used.

The adaptor could be designed to be placed directly on a surface when not secured to the appliance, but in a set of preferred embodiments it is designed to be secured instead to a base unit.

The adaptor could be connectable directly to a suitable power outlet to provide electrical power, but preferably it is connected to the base unit, with the base unit in turn being connected to the power outlet. Water is supplied to the mobile unit from the reservoir in the base unit.

Providing a water supply allows operation in a cordless mode, when the adaptor is not coupled, whereby the reservoir of water in the mobile unit is used and replenished when the appliance is replaced on the adaptor; or a corded mode whereby water and electricity can be supplied to permit longer and/or higher performance use. In some embodiments the means for supplying water from the adaptor to the mobile unit comprises valve means on either side of the connection to prevent leakage either from the adaptor or from the appliance when the two are not connected, during the process of connection, or when connected.

The mobile unit and base unit need to be designed so that they do not inadvertently disconnect from one another. If only an electrical connection were being made, it would be relatively easy to achieve this simply by means of the weight of the appliance, which would typically be much greater than the spring force necessary to maintain a good electrical connection between the electrical contacts. However, as a water connection is also provided, particularly where the water supply is at significant pressure, the weight of the appliance alone may not be sufficient to ensure that a firm connection is maintained since as well as the electrical contact spring force, the force required to hold the respective valves open and the force exerted by the water pressure will tend to act to separate the connectors.

In some embodiments of the invention therefore the base unit and/or the mobile unit are configured to prevent unwanted disconnection therebetween. In some embodiments, such configuration can be provided by means which secure the mobile unit to the base unit. Indeed, this could simply be the same means by which the adaptor can be secured to the mobile unit for use in corded mode. However, this is considered to be relatively inconvenient for a user as it requires positive disconnection of a clip or other fastening means before the mobile unit can be lifted or moved from the base station which negates some of the convenience advantages associated with a cordless appliance.

In a set of embodiments therefore the base unit and mobile unit comprise means for preventing separation in a direction substantially parallel to the axis of the connection, but which permit removal of the appliance in a direction non-parallel to said axis. In such embodiments the configuration of the base and mobile unit prevent disconnection under the force of the pressurized water supply tending to separate the connectors and/or the contact force of the electrical connector, whilst still allowing the user to remove the mobile unit from the base simply picking it up in an appropriate direction. One possible way of implementing this would be to provide a recess on the base unit into which the appliance could be seated by a tilting or rotating action with the distal wall of the recess, or indeed any other mechanical arrangement, preventing movement along the connector axis, i.e. tangential to the tilting action required to place or remove the mobile unit. Another example would be a hook or ridge on one of the mobile unit or the base unit cooperating with a corresponding feature on the other.

As mentioned above, such arrangements are particularly beneficial where there is a relatively high force tending to separate the connectors, e.g. where the connectors include a pressurized water connector. In an exemplary set of embodiments the force tending to separate the connectors is greater than a quarter of the weight of the mobile unit. In such applications, it is inadvisable to rely on the weight of the mobile unit alone to provide the connector closure force since the relatively significant opposing force can make a secure connection difficult and can make the connection unstable to being gently knocked or rocked.

Since in accordance with the arrangements set out above it is no longer necessary to rely on the weight of the mobile unit to provide the closure force on the connectors, the system designer is given greater freedom as to the orientation on which the appliance rests on the base unit. Thus, rather than requiring the cordless water and possibly electrical connectors to be provided on a face of the mobile unit on which the appliance is adapted to stand, they could be applied by a different surface. To give an example in the context of an electric iron, the cordless connectors might be provided on the back end of the iron on which the iron is stood when it is being rested during use, but when placed on the base, the iron could be placed at an angle nearer to the horizontal or indeed fully horizontal. Accordingly, in a set of embodiments a cordless base unit is provided having electrical power and water connections on a surface having an angle of less than 45° to the vertical.

Completely independent cordless connectors for electrical power and water could be provided. However, this could make it more difficult to mate the mobile unit with the base unit as it might require simultaneous alignment between the two separate connectors. In preferred embodiments, the power and water connections are provided with a mutual alignment of mating parts, often referred to in the art as a common coning arrangement. In other words, there is a single guidance alignment system to control the direction of approach of the appliance to the base unit during engagement or disengagement. In a set of preferred embodiments the connections are arranged such that after physical contact has been made between one pair of connectors and they are subsequently brought towards their full alignment axis, physical contact is made between the other pair of connectors. Having sequential contact like this is beneficial where one pair of connectors have a greater tolerance to the initial angle when contact is first made than the other pair of connectors. For example the tolerance to initial angle, often known as the coning angle, tends to be greater for the electrical connectors than for the water connectors.

The water and electrical connectors could be arranged side by side. However in some embodiments they are arranged one above the other; that is to say one at a greater height than the other, when the iron or other mobile unit is on its base unit. This is beneficial as it limits the degree of alignment which it is necessary for a user to carry out, given that the base unit gives alignment in a vertical plane.

In one set of embodiments, one half of each connector could be provided in a concave formation on one of the mobile unit and the base part with the other halves of the connectors being provided in a corresponding convex formation on the other of the base unit and the mobile unit.

In some sets of embodiments of various aspects of the invention, a base unit is used to provide a pressurized water supply to a cordless mobile unit when the latter is placed onto the base. In some such embodiments, the base water supply is continuously pressurized since this allows a pressurized on-board reservoir in the appliance to be recharged in accordance with the preferred embodiments. As alluded to earlier, even in an arrangement where the base and mobile units are configured to prevent the pressure of the water separating the connectors when the mobile unit is fully engaged on the base, the presence of the water pressure and the force required to hold the respective valves open could nonetheless make it more difficult for a user to bring the connectors together. These are both in addition to the force exerted by the spring contacts in the electrical connector.

In one set of embodiments, the base unit is provided with means for reducing the pressure of a pressurized water supply while a user is connecting, and optionally disconnecting, the cordless appliance to/from the base unit. There are of course many ways in which this could be done. For example, manual intervention by a user, e.g. to press a button, could be used. Preferably however the base unit is arranged to detect when the mobile unit is brought into engagement with it.

There are any manner of ways in which this can be done using optical, magnetic, capacitance sensors, etc. but preferably a simple micro-switch is arranged to be operated as the appliance is brought into engagement. This could be an electrical micro-switch to reduce the pressure e.g. by reducing the speed of or switching off a pump, or a direct mechanical arrangement e.g. closing a valve or throttle to limit or stop water flow.

As will be appreciated from the foregoing description, the coupling between the base and mobile unit could be achieved by attaching a releasable adaptor of the kind described or simply by placing the mobile unit onto the base unit in an appropriate manner.

In accordance with all embodiments of the invention the pressure of the pressurized water either supplied to or stored within the mobile unit, is preferably at least 0.5 bar preferably at least 1 bar and in some cases is greater than 3 bar.

BRIEF DESCRIPTION OF THE DRAWINGS

Certain preferred embodiments of the invention will now be described, by way of example only, with reference to the accompanying drawings in which.

DETAILED DESCRIPTION OF THE INVENTION

Figure 1:
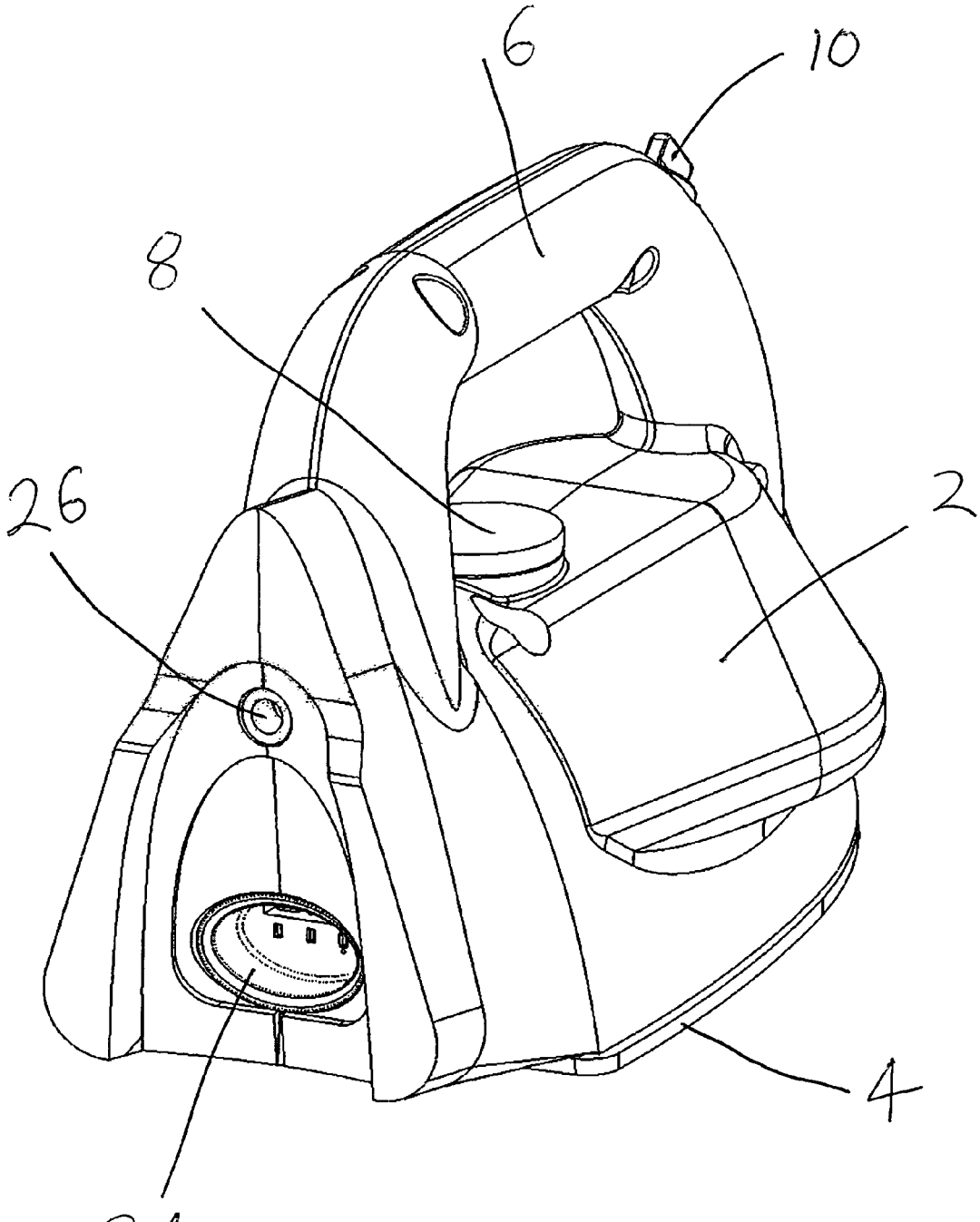
FIG. 1 is a perspective view of an iron in accordance with an embodiment of the invention.

FIG. 1 is an external view of a steam iron 1 which embodies several aspects of the invention. In FIG. 1 can be seen the main body 2, an electrically heated sole plate 4 and a handle 6. A temperature selector knob 8 is provided on the body 2 beneath the handle 6. A further knob 10 is provided on the front of the handle 6 to allow a user to control the amount of steam supplied by the iron (alternatively it could simply allow steam to be switched on or off). At the rear of the iron is a cordless electrical connector 24—here the male part of the Applicant's P75 cordless electrical connector set but of course any other suitable connector could be used—and a water connector 26.

Figure 2:
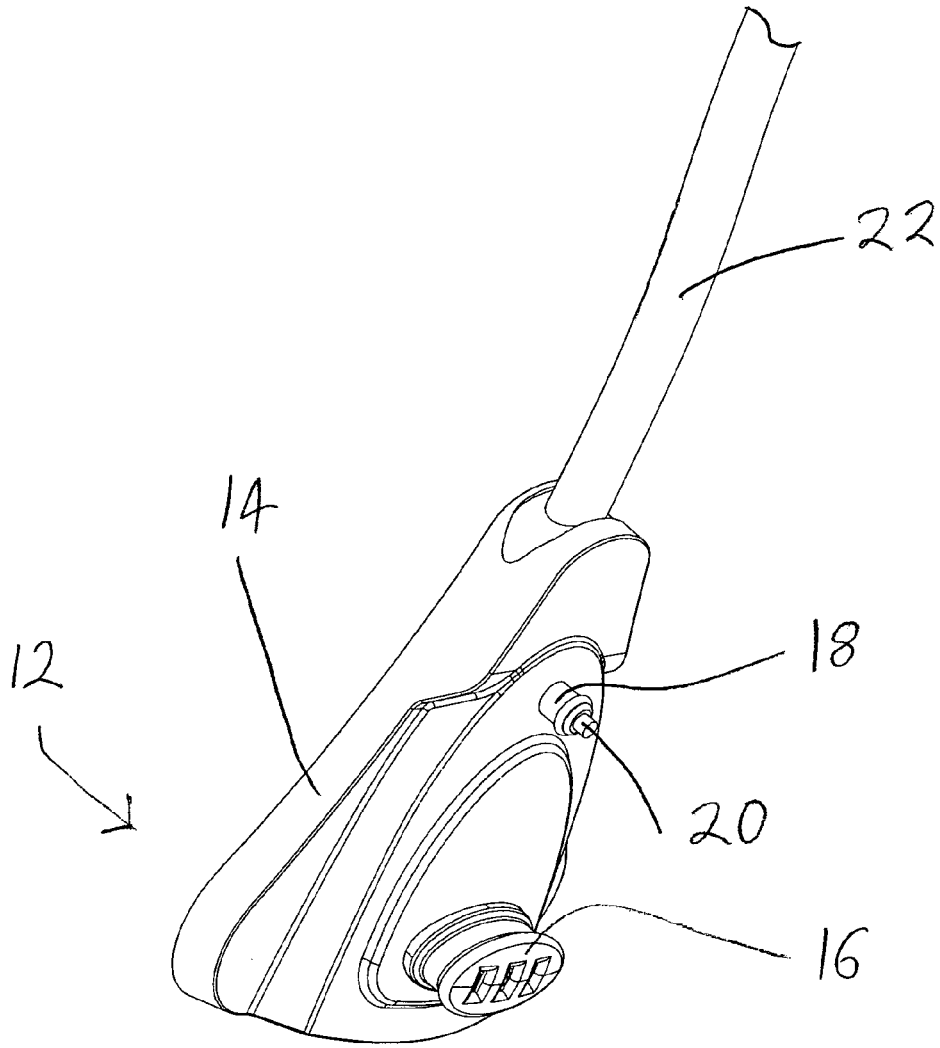
FIG. 2 is a view of an adaptor for supplying electrical power and water to the iron shown in FIG. 1.

FIG. 2 shows an adaptor unit 12 for connection to the rear of the iron for supplying the iron with electrical power and water. The adaptor comprises an outer body 14. Projecting from one face of the body 14 is the female part 16 the Applicant's P75 cordless connector set. Above the electrical connector 16 is the water connector 18 which comprises a valve 20. An umbilical cord 22 connects the adaptor 12 to a base unit (not shown) and carries inside it separately insulated electrical wires and a tube for carrying water. These are connected to the electrical connector 16 and the water connector 18 respectively.

Figure 3:
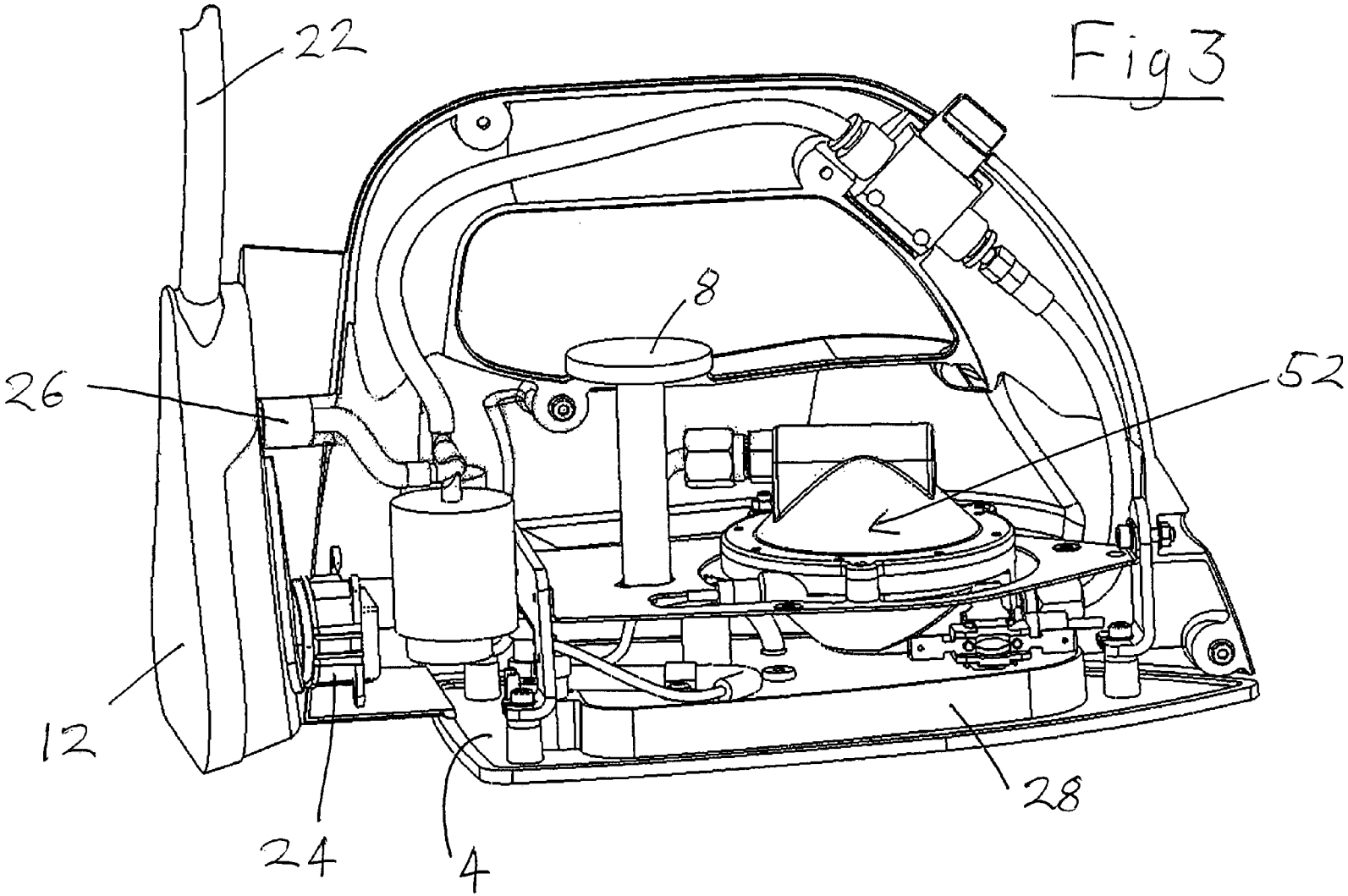
FIG. 3 is a cut-away view showing the internal components of the iron with the adaptor fitted.
Figure 4:
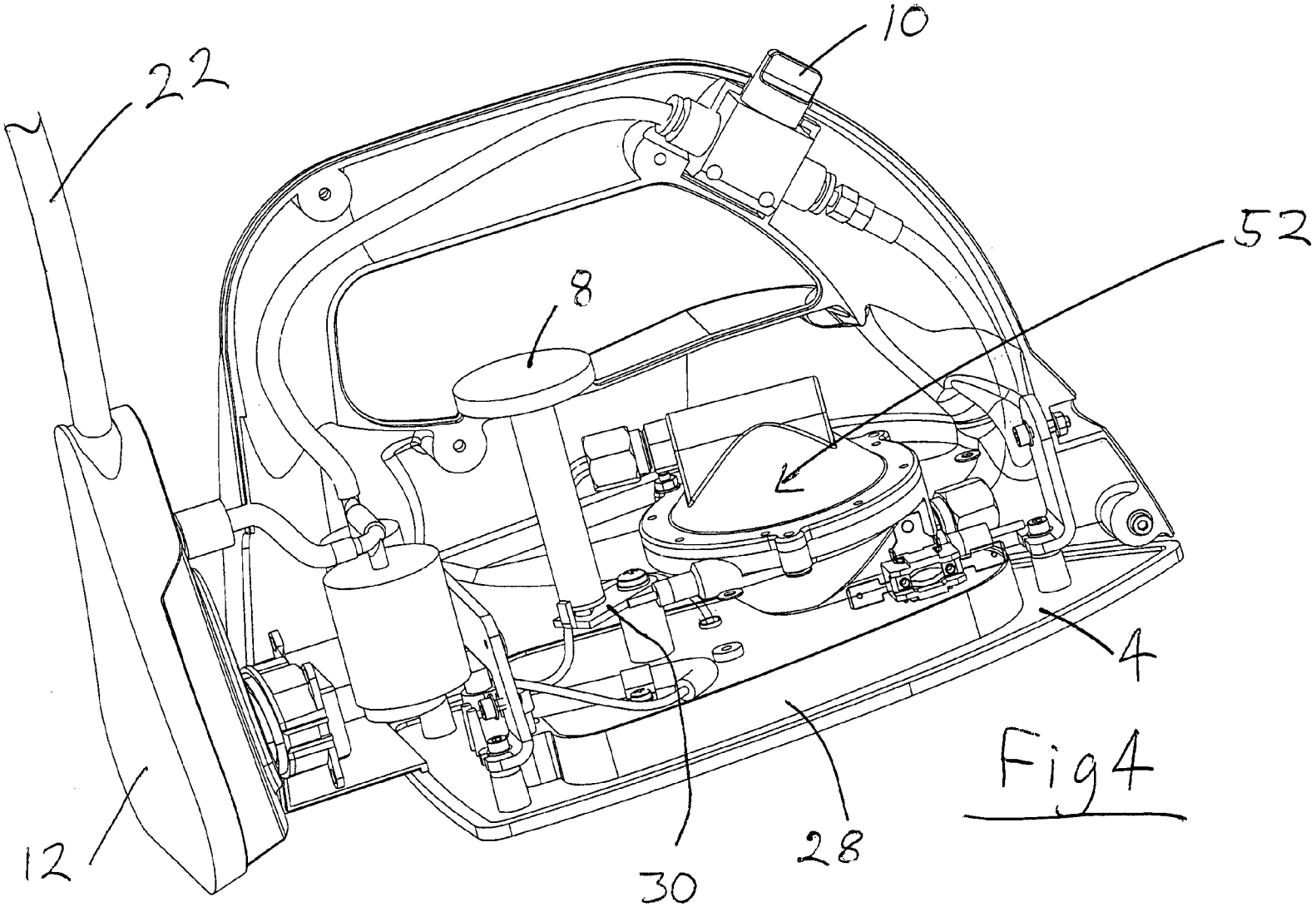
FIG. 4 is a view similar to FIG. 3 with some of the internal components removed for clarity.

FIGS. 3 and 4 show cut-away views of the iron with the adaptor 12 connected to it. Thus, at the rear of the iron the electrical connectors 16, 24 are mating as are the water connectors 18, 26. The water connector parts 18, 26 are configured so that when they are sealingly connected to one another, pressure is applied to the valve 20 and to a corresponding valve (not shown) in the iron-side connector part 26 to allow water to flow. The valves on each respective water connector 18, 26 prevent the leakage of water when the adaptor 12 is separated from the iron.

On the inner face of the iron's sole plate 4 is an element block 28 inside which is provided a resistance heating element for heating the sole plate 4 as is conventional. The sole plate element is connected to the electrical power inlet 24 by means of a thermostat arrangement 30 which can be seen more clearly in FIG. 4 but which is in good thermal contact with the sole plate element. The temperature control knob 8 is connected to the thermostat arrangement 30 in order to switch power on and off and to set the thermostat to give the desired temperature range of the sole plate 4. The boiler module 52 is also visible.

Figure 5:
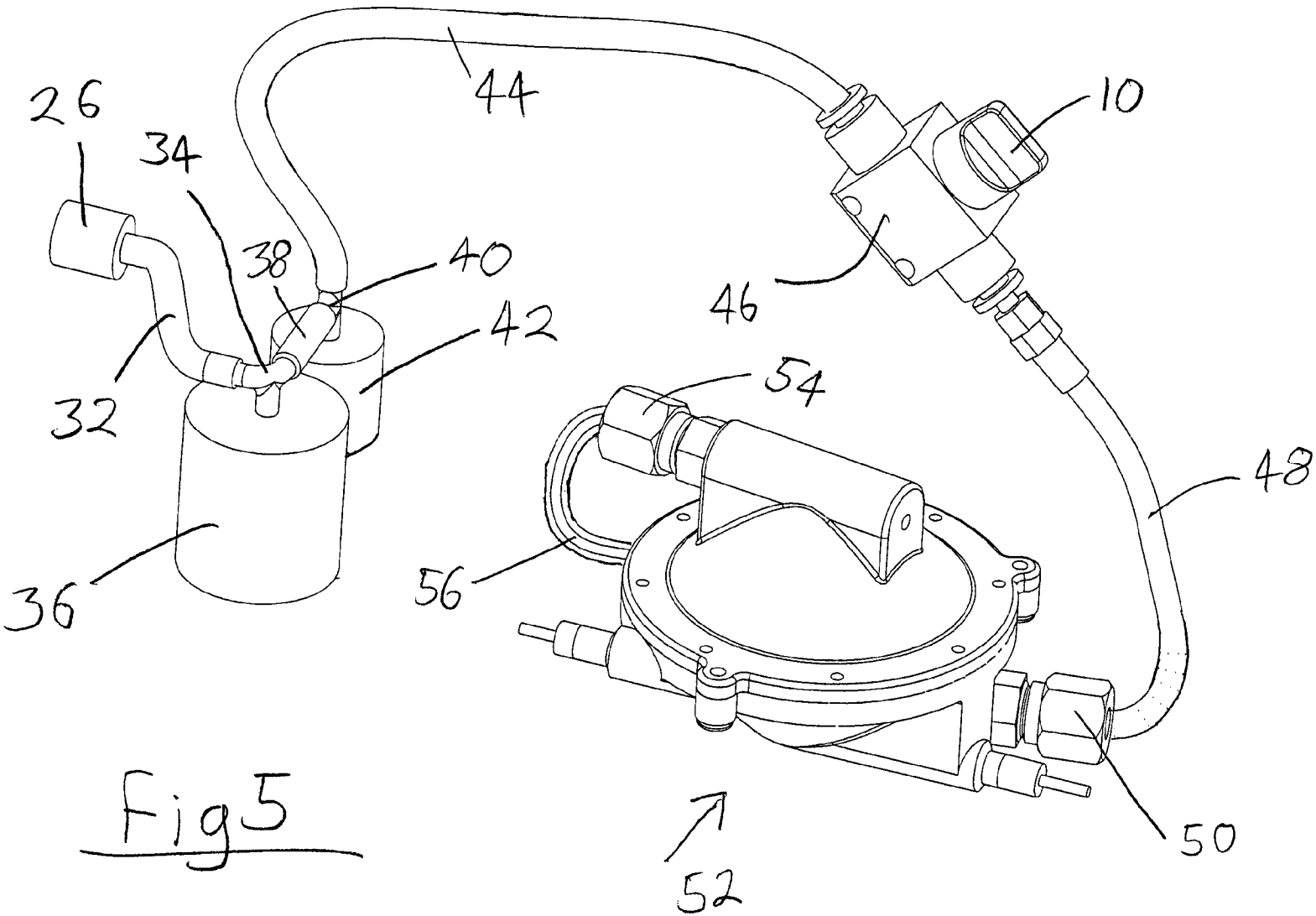
FIG. 5 is a view of the internal components making up the water and steam system.

The water and steam system inside the iron will now be described with reference to FIG. 5 in which the other parts of the iron have been removed for clarity. A short flexible tube 32 connects the water inlet connector 26 to a T-piece connector 34, the stem of which is connected to a pressure accumulator 36, which in use forms an on-board water reservoir as will be explained in greater detail further below. A further short tube 38 joins the T-piece connector 34 to a second T-piece connector 40 on a second pressure accumulator 42, which in use acts as a surge water store as will be explained in more detail further below.

Figure 6:
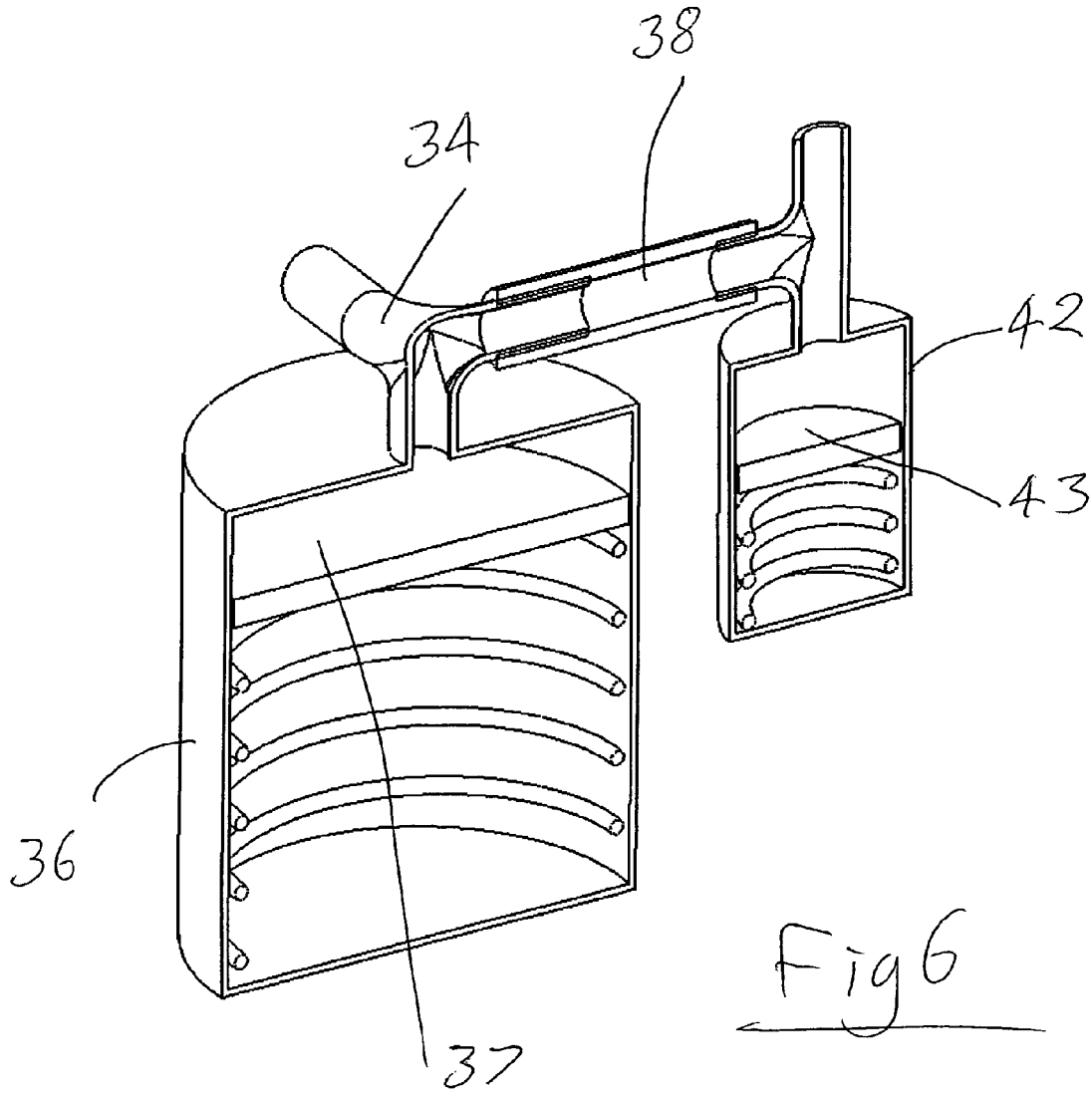
FIG. 6 is an enlarged cross-sectional view of the two pressure accumulators.

FIG. 6 shows a sectional view of the two pressure accumulators 36, 42 in more detail. As may be seen from this Figure, inside each pressure accumulator 36, 42 is a sprung piston 37, 43 respectively. These pistons 37, 43 apply pressure to water which is stored inside the respective accumulator. The pressure applied is dependent upon the spring force of the corresponding spring. In this embodiment, the spring force of the piston 43 in the surge accumulator 42 is greater than that of the piston 37 in the on-board reservoir accumulator 36. This means that once the surge accumulator 42 has emptied during the initial period of water supply, it will not be refilled by the on-board reservoir accumulator 36.

A longer piece of flexible tubing 44 connects the T-piece connector 40 on the surge accumulator 42 to a variable valve 46 which is operated by the user-operable steam knob 10. Alternatively a simple on-off valve could be used. Downstream of the valve 46 is a further tube 48 which connects at its other end to the inlet 50 of the boiler module 52. The boiler module 52 is described below in greater detail with reference to FIGS. 7 to 10. The steam outlet 54 from the boiler module is connected to a further tube 56 which conveys the steam exiting the boiler module 52 into a plenum in the element block 28 formed on the upper side of the sole plate 4 (refer to FIG. 3) and out from there through a plurality of apertures in the sole plate.

Figure 7:
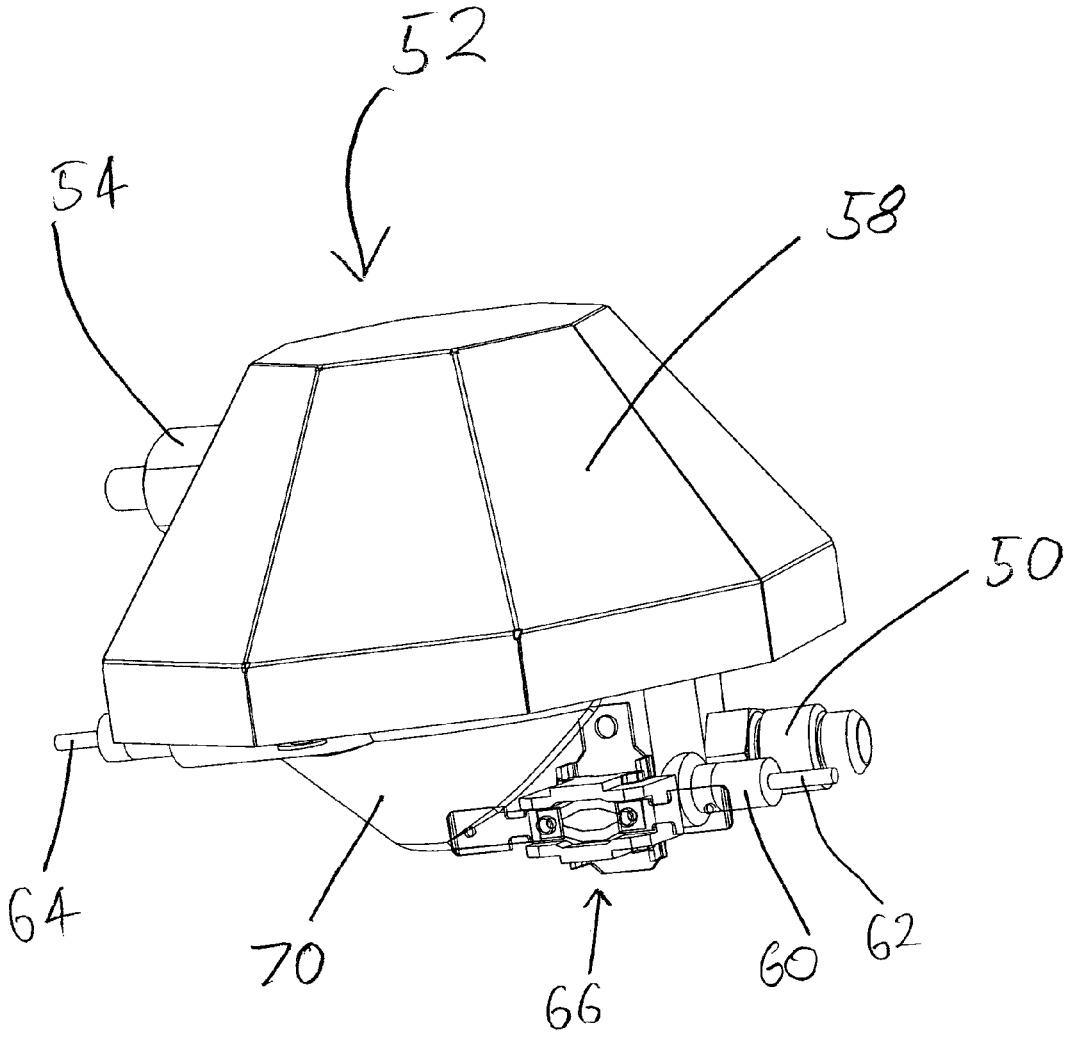
FIG. 7 is an enlarged view of the compact steam generator module.

The novel boiler module 52 will now be described in greater detail with reference to FIGS. 7 to 10. FIG. 7 shows the external appearance of the boiler module 52. The boiler 52 is largely covered by a heat-resistant cover 58 which is e.g. made of one or more layers of mica, but can be made of any suitable substance. In the lower right hand region (when viewed from FIG. 7) of the module there can be seen the water inlet 50 and the end of a sheathed electrical resistance heating element 60. A projecting metal connector 62 (known in the art as a cold tail) is provided to enable electrical connection to the element 60. A similar cold tail 64 is provided at the other end of the element which is visible on the left hand side of FIG. 7. A high temperature regulator 66 is provided against a flange 68 (see FIG. 8) on the lower body member 70 of the boiler. The steam outlet 54 is visible in the top, left hand part of FIG. 7.

Figure 8:
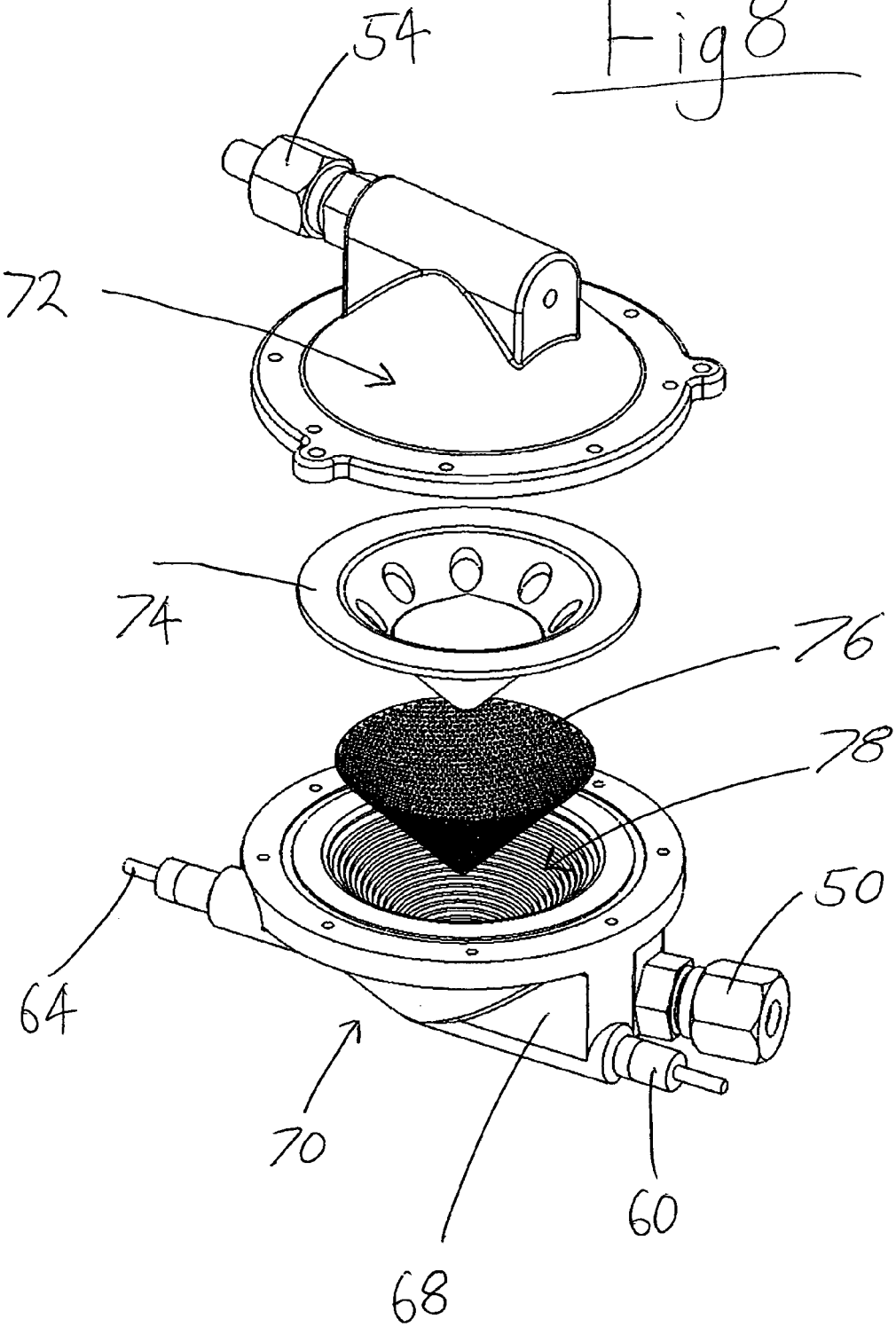
FIG. 8 is an exploded view of the steam generator with the outer cover removed.

With particular reference now to FIG. 8, it can be seen that the main section of the boiler is made up of four main parts: the lower body member 70, a corresponding upper body member 72 and an intermediate conical member 74 which may all be made of non-ferrous die-cast metal or other suitable material; and a conical mesh layer 76, e.g. of stainless steel.

When assembled, the upper and lower body members 70, 72 are clamped together by suitable means and this retains the intermediate conical member 74 and mesh cone 76 between them. A suitably heat-resistant seal is provided between the upper and lower body members 72, 70, although this has been omitted for clarity.

It may be seen that inside, the lower body member 70 defines a conical chamber 78 which receives the intermediate conical member 74. The inner wall of this chamber 78 is formed with a series of concentric annular steps, the purpose of which will be explained later. The conical member 74 is spaced from the wall of the chamber 78 by a constant amount across its surface to form a narrow evaporation space. The evaporation space is filled by the mesh 76 which is thick enough to touch the surfaces on both sides of the narrow gap.

Figure 9:
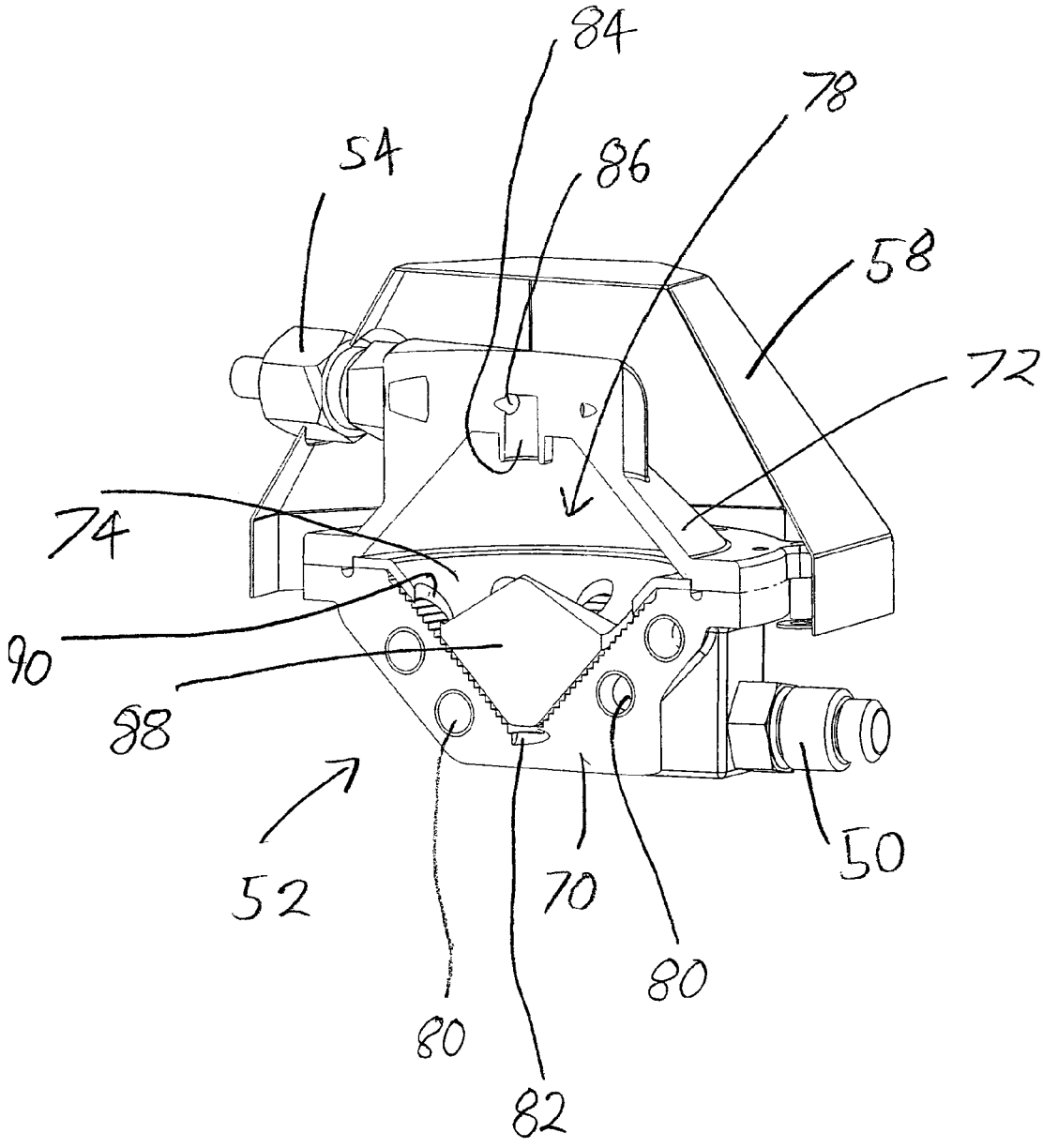
FIG. 9 is a sectional view through the steam generator.

FIG. 9 shows a cross-section through the assembled module 52. This Figure shows that the lower body member 70 has much thicker walls than the upper body member 72 since they accommodate an embedded heating element 60. This is cast into the lower body member during manufacture, although is omitted from FIG. 9 so that only the passage 80 it forms is visible. The embedding of the heating element 60 in the wall of the lower body member 70 can be seen in FIG. 10. The element is approximately helical so that it wraps around the conical cavity formed by the lower body member 70. This ensures an even heat distribution across the lower, tapering wall of the chamber 78.

At the lowest point of the steam chamber 78 is the opening 82 of another passageway through the walls of the lower body member 70 which fluidly communicates with the water inlet 50. At the top of the chamber 78 there is a steam outlet formed by a short section of tube 84 which projects downwardly into the chamber 78 and is in fluid communication with a narrow passageway 86 through the upper body member 72 and which communicates with the steam outlet 54.

Figure 10:
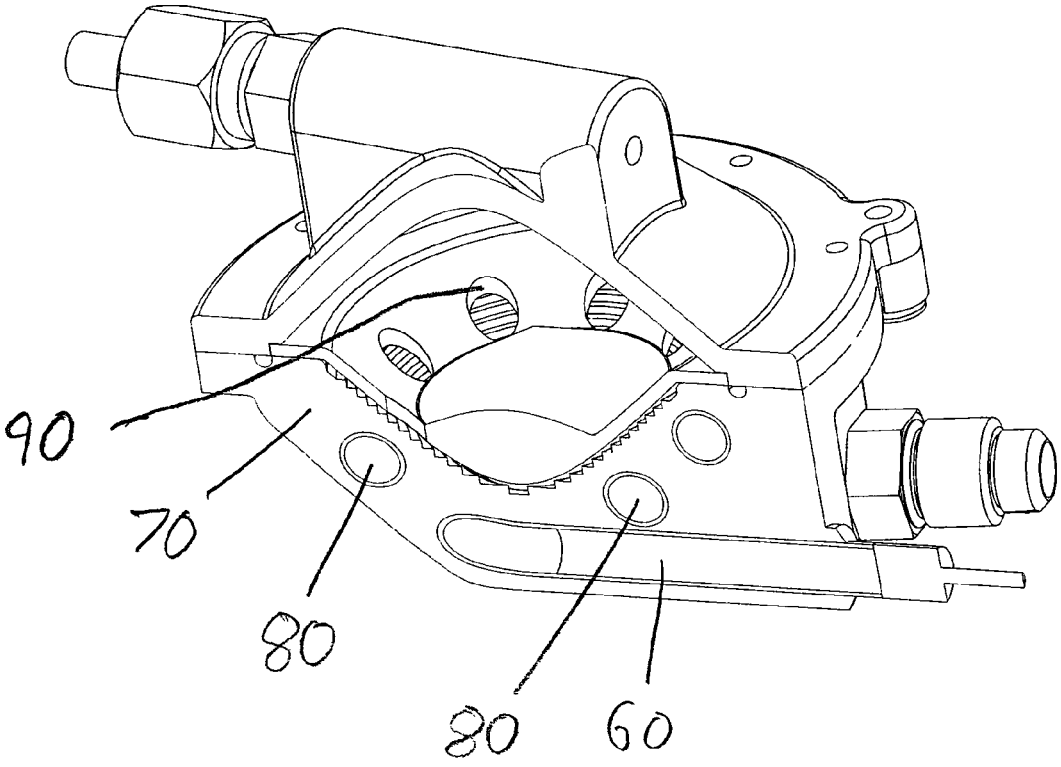
FIG. 10 is another sectional view through the steam generator.

As can be seen from FIGS. 8, 9 and 10, the intermediate conical member 74 comprises a solid lower portion 88 and has a series of apertures 90 around its upper portion. The mesh cone has been omitted from this Figure for clarity. It should be appreciated that neither the mesh cone nor the intermediate conical member is essential.

The internal heat transfer surfaces—that is the walls of the chamber 78 and the intermediate conical member 74—are coated with a functional heat resilient surface coating that enhances the transfer of heat into the water. The coating improves the speed of heat absorbed by the water particularly at operating temperatures above 160° C. and below 380° C. The functional coating could instead be selectively applied just to the interior of the evaporation space between the lower, tapering part of the chamber wall 78 and the solid part 88 of the intermediate member. The design of the chamber facilitates such simple selective application prior to assembly. The coating can be applied in a single coat. To ensure its durability it may however be necessary subsequently to cure it at an elevated temperature. The method of application need not be complicated and can be accomplished without sophisticated equipment—e.g. via spray, brush, roller or any other suitable method. However other methods can be employed such as electrolytic, electrostatic, plasma, thermal spray, vacuum deposition, spin coated, sol gel process, evaporation and others.

The functional coating provides a hydrophilic surface and substantially increases the available heat transfer surface area of the evaporation space by giving the coated surfaces thereof a microstructure. A micro-surface and partially sub-surface structure is imparted by the coating as it creates a surface matrix and micro-textured surface. Additionally the coating is thermally shock resilient, adheres strongly to the internal surfaces and preferably inhibits corrosion.

It will be seen that the internal configuration of the boiler has heat transfer surfaces that are configured to operate at different scales through use e.g. of the functional coating which operates to improve thermal transfer efficiencies at dimensions between the nano and micro scales. The surface to which the coating is applied is configured to impart a texture to the coating operating between a micro and macro scales. The stepped surface structure on the other hand operates to enhance heat transfer at a macro scale. Therefore the evaporation space operates as a complex heat transfer surface/matrix with additional complex heat transfer surface/matrix interactions at the micro and nano scale provided by the functional coating. The stepped structure can also assist adhesion of the coating.

The various internal zones, cavities and openings of the boiler are arranged to create predetermined varying resistance to the internal flow of water/steam and also provide for a preferential direction of flow, wherein generally the zones are configured to provide a sequential increase in volume corresponding to the temperature of the fluid and its properties. Hence there are reducing obstructions and resistance to flow within the chamber as fluid progresses through it to the exit. The configuration is such that the internal steam pressure generated within the boiler device is not greater than that of the water pressure entering the device. This avoids water being prevented from entering the device, resulting in a subsequent drop in steam flow rate and unwanted fluctuation in steam output.

Figure 11:
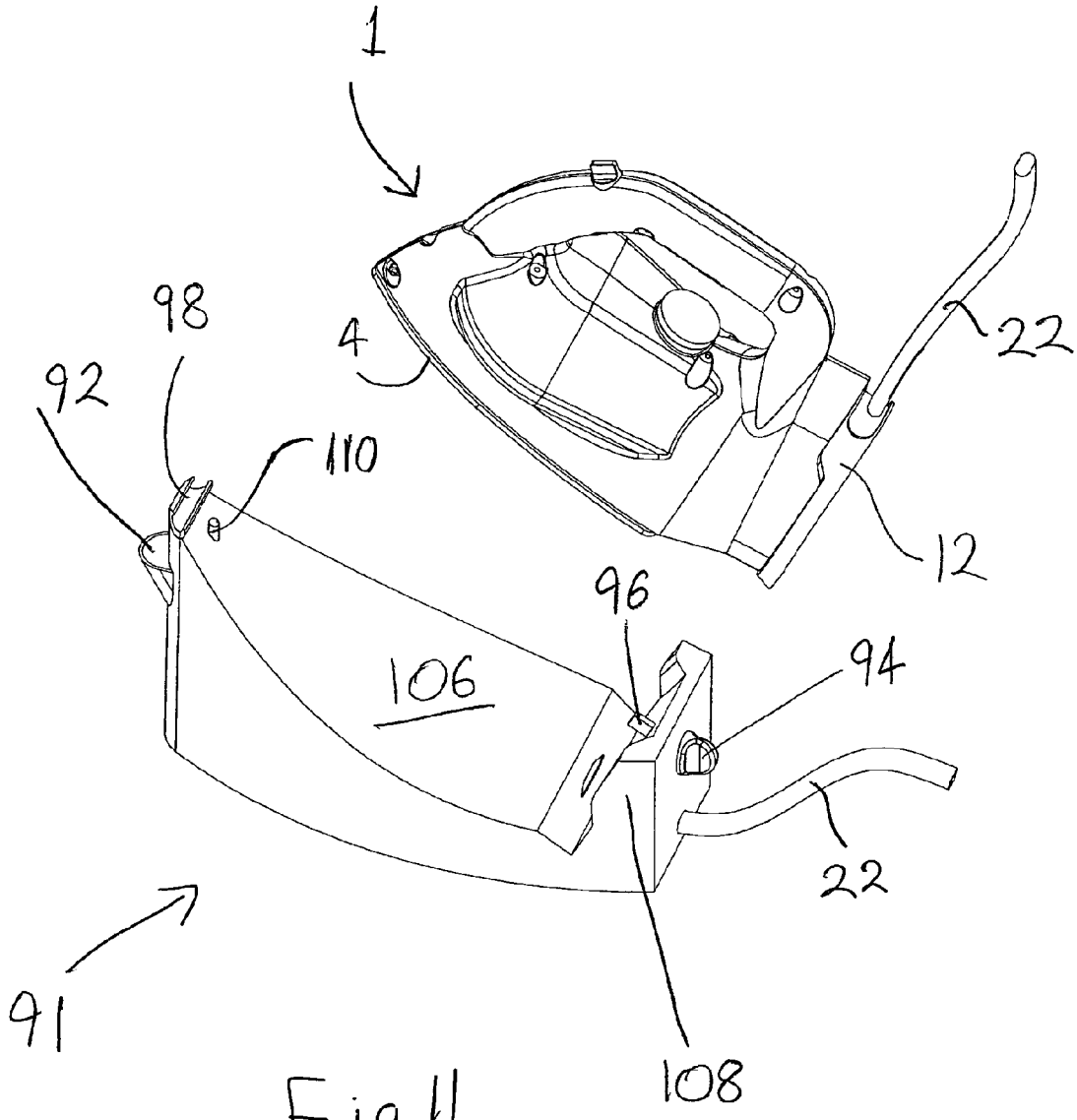
FIG. 11 is a perspective view of the iron described with reference to FIGS. 1 to 10, operating in a corded mode, and a base station.

FIG. 11 shows an iron 1 and corresponding base station 91 which are configured for use in a corded mode. Most of the volume of the base unit 91 is taken up by an internal water reservoir which may be filled at an inlet spout 92. A water outlet pipe extends into the water reservoir and is terminated by a sodium, potassium or hydrogen form demineralizing filter. The outlet pipe is connected to an electrically operated pump (not shown) which can pump water from the reservoir along a pipe in the umbilical cord 22 to the water outlet 18 of the adaptor 12 (see FIG. 2). The arrangement includes a pressure relief valve which can open into the water reservoir either above or below the water level. This prevents a dangerous build-up in pressure if there should be a blockage in any part of the system. If the pump is run continuously it also prevents stalling of the pump which would overheat it and reduce its reliability. The filter is provided between the reservoir and the pump but this is not essential. The recirculation of water inherent in the use of such a valve is also beneficial in improving filtration of the water.

On the top of the base unit is a stand for the iron which comprises a gently inclined and curved base portion 106 and an upstand portion 108 at right angles to the base portion 106. In use the base portion 106 faces the sole plate of the iron and the back of the iron rests against the upstand portion 108. The upstand portion 108 is shaped to allow it snugly to receive the adaptor 12. On the back of the upstand is a user-operable knob 94 which can advance or retract a locking pin 96 for locking the adaptor 12 to the upstand 108 when the iron is being used in cordless mode as will be explained below with reference to FIG. 12.

At the other end of the base unit 91 there is a rotatable clip 98 having a C-shaped cross section. As will be explained later with reference to FIG. 13, this receives the tip of the iron's sole plate 4. A little way beneath this, protruding from the base portion 106 is a microswitch 110 which can detect when the iron has been placed on the stand. Of course any other contact or non-contact sensor arrangement could be employed instead.

Although not visible in FIG. 11, an electrical flex is also provided for connecting the base unit to a mains power outlet. This provides power for the pump and also provides the electrical power supply to the adaptor 12 via the umbilical cord 22.

In FIG. 11 the iron is being used in a corded configuration. In this configuration, the adaptor 12 is secured to the back of the iron 1 so that water and electricity can be supplied from the base unit 91 while the iron is being used.

Figure 12:
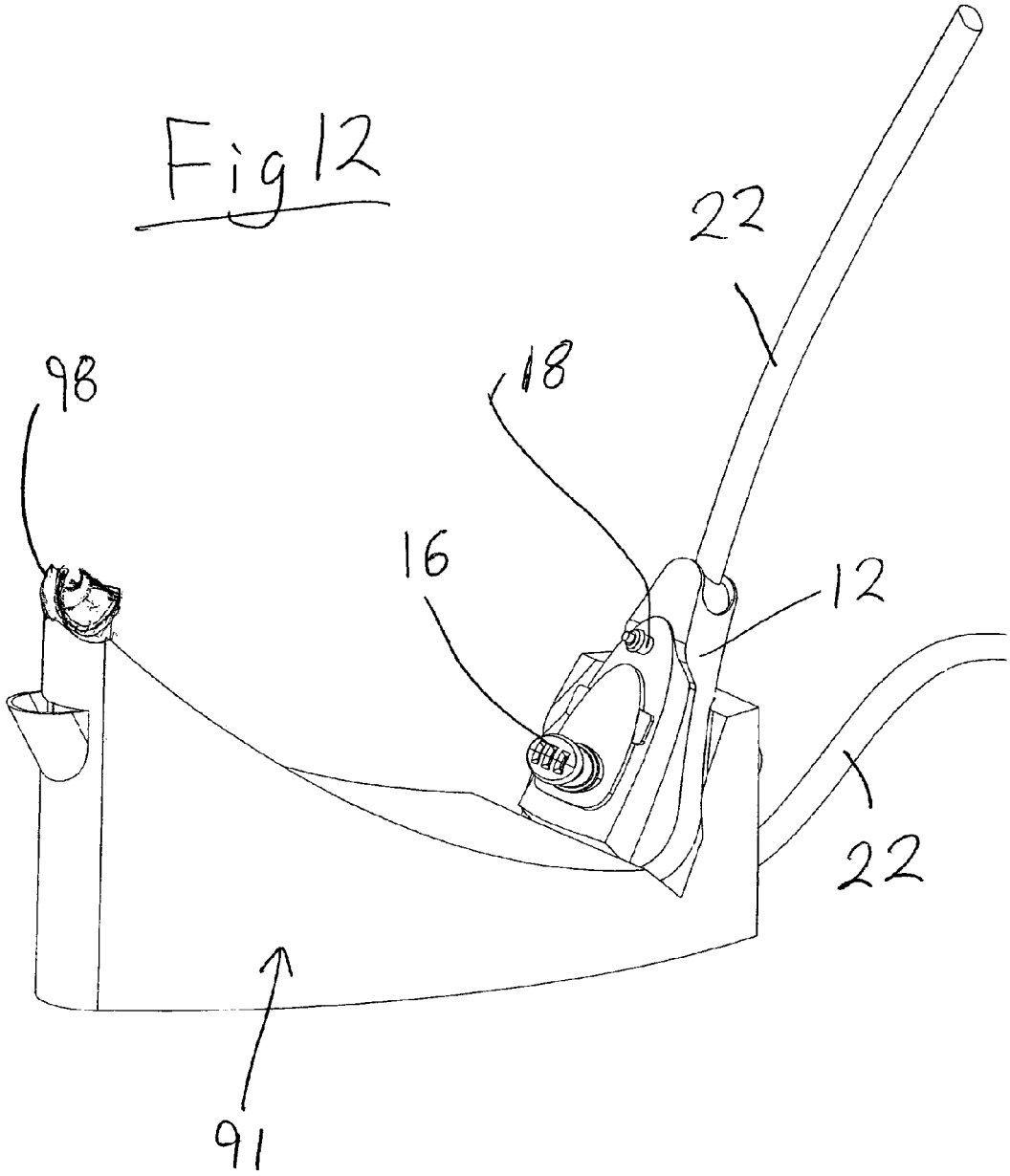
FIG. 12 is a view of the base configured for use of the iron in a cordless mode.

In FIG. 12, the adaptor 12 is instead secured to the upstand portion 108 of the base using the locking pin 96 to allow the iron to be used in a cordless mode. In this mode, water and electricity are only supplied to the iron when it is placed on the base unit 91.

Figure 13:
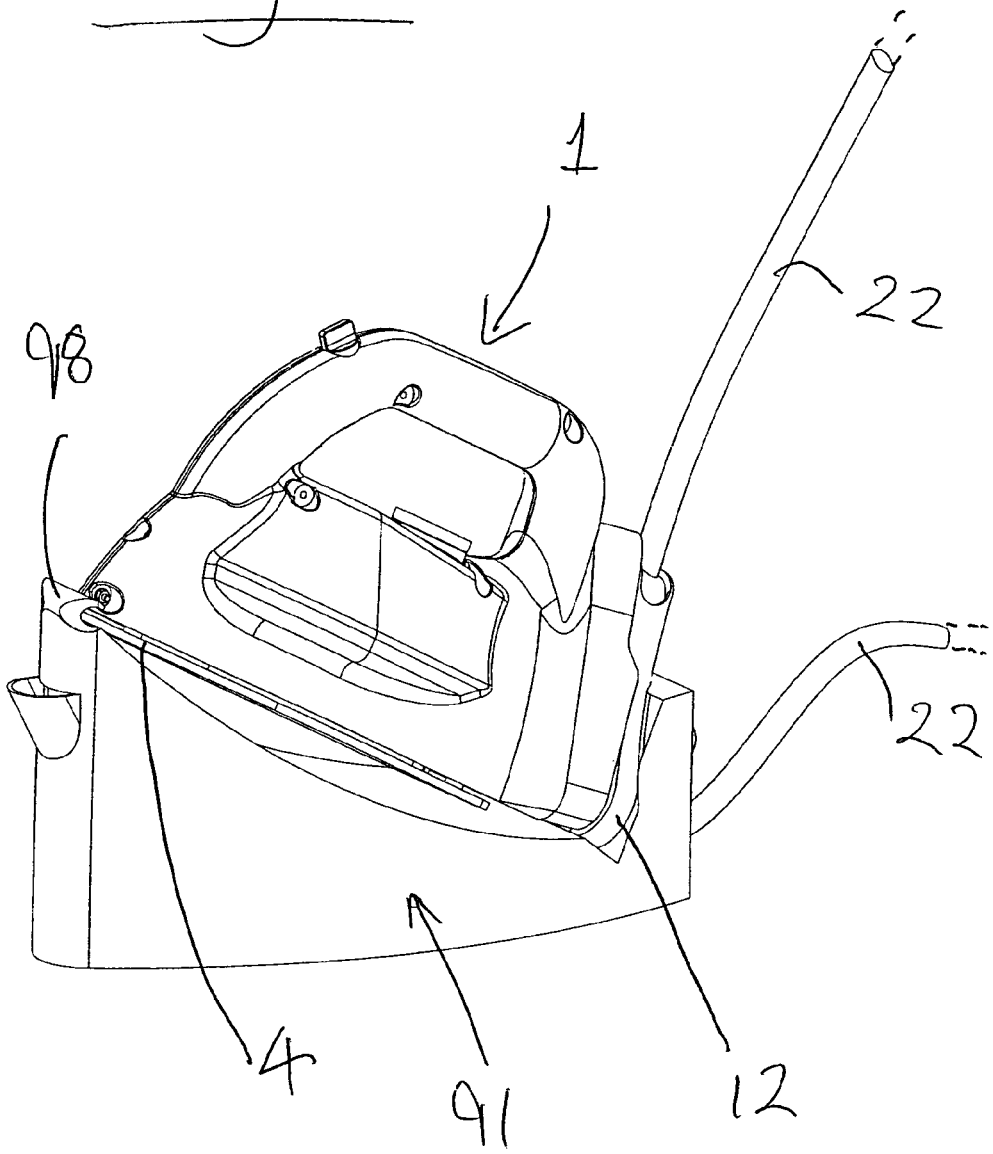
FIG. 13 is a view of the iron seated on the base.

FIG. 13 shows the iron 1 seated on the base. Here it can be seen that as the tip of the sole plate 4 has been received in the rotatable clip 98, it causes the clip to rotate and lock it against axial movement away from the adaptor 12 secured to the base unit upstand 108 containing the cordless connectors 18, 24. This prevents separation of the cordless connectors on the iron 1 and adaptor respectively under the separation force provided by the water pressure from the pump, the valve pressure and the electrical contact force. The C-section clip 98 prevents movement of the iron 1 relative to the upstand portion 108 in a direction parallel to the plane of the sole plate 4, i.e. in a direction parallel to the axes of the water and electrical cordless connectors. This therefore prevents the tendency of these connectors to separate. However, placement and removal of the iron can be easily achieved by tilting the iron 1 out of the clip 98 to remove it and pivoting it into the clip 98 to replace it. Of course, many other configurations could be used to give this effect.

Figures 14A, 14B, 14C, 14D, 14E:
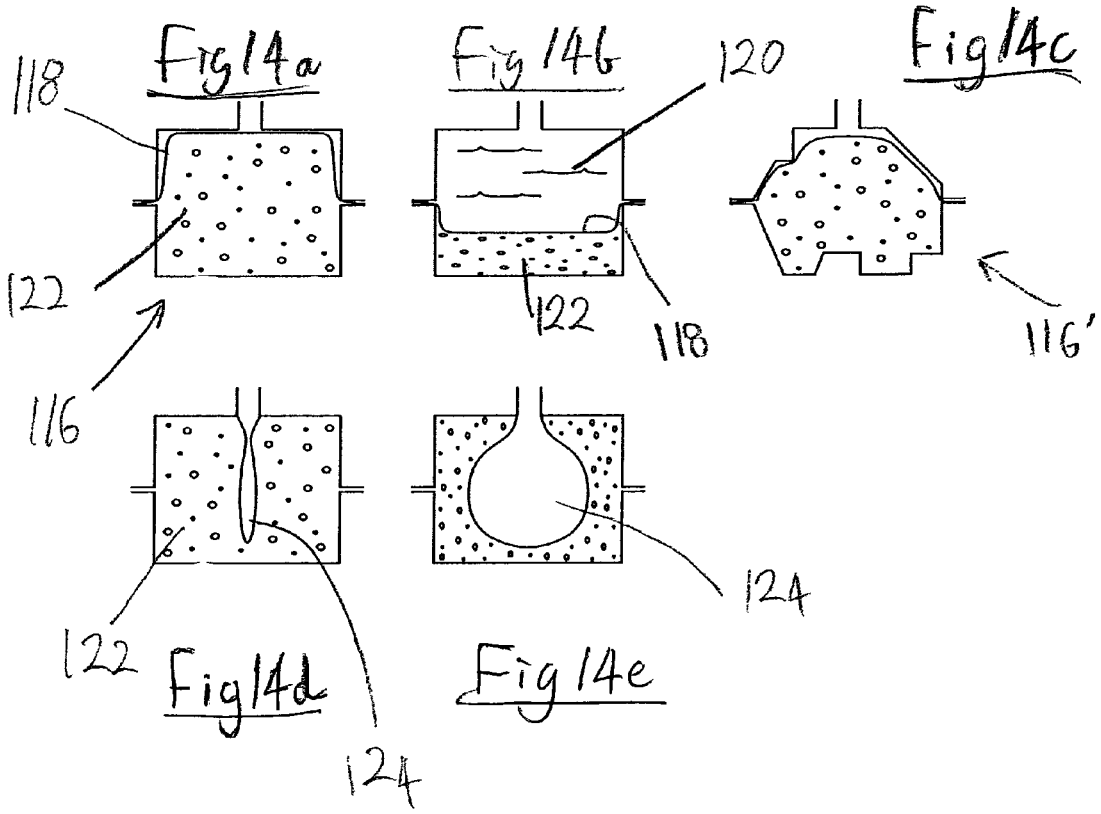
FIGS. 14*a-e* show schematically various alternative embodiments of either or both of the pressure accumulators.

FIGS. 14*a* to *e* show, schematically, further possible embodiments of one or both of the pressure accumulators provided in the iron (see FIG. 6 for reference). FIGS. 14*a* and 14*b* show a pressure accumulator 116 which has a flexible internal membrane 118 which divides the internal space in the accumulator between a water receiving space 120 and a compressible medium 122, such as an elastomeric material with low compression set. This means that as water fills the space 120, the medium 122 is compressed but in turn applies a reactionary pressure to the water to pressurize it.

FIG. 14*c* shows a variant of this which illustrates that the walls of the accumulator 116' need not be regular in shape and can therefore be designed to fit into an irregular space inside an appliance, thereby making maximum use of the space available. FIGS. 14*d* and 14*e* show a similar arrangement in which a bladder 124 can expand into the compressible medium 122 as it is filled with water. The bladder 124 might itself be elastically expandable to enhance the pressure on the water when it is filled.

Operation of the iron will now be described with reference to FIGS. 1 to 12.

Operation in cordless mode will be described first. With reference to FIG. 12, the adaptor 12 is secured to the upstand 108 of the base unit by means of the locking pin 96 (not visible). To commence operation, the iron 1 is placed on the base unit so that the electrical power and water cordless connectors 16, 18 respectively of the adaptor engage the corresponding connector parts 24, 26 of the iron. In this embodiment when the iron is placed on the stand, its presence is sensed by the microswitch 110 which switches on the pump to start pumping water into the iron. Alternatively the pump can run continuously (in which case the microswitch could be omitted. The water is pumped through the water tube in the umbilical cord 22, through the opened valves of the cordless water connector 18, 26 and so into the water system inside the iron. Since the user-operated variable valve 46 should be closed whilst the iron is on the base, the water pressure developed by the pump fills the on-board reservoir accumulator 36 and the surge accumulator 42 against the force exerted by the respective sprung pistons 37, 43. Once the accumulators 36, 42 and various pipes 32, 38, 44 are filled with water, the system is fully pressurized and the flow of water from the tank 92 in the base stops. If a pressure relief valve is provided this will then act to divert the water to recirculate within the reservoir.

While the iron 1 is on the base 91, electrical power is supplied via the umbilical cord and cordless connector parts 16, 24 to heat the sole plate element (not shown). This heating is regulated by the thermostat 30 depending upon the setting of the temperature control knob 8, as is well known in the art. Independently of the heating of the sole plate element, electrical power is also supplied to the sheathed resistance heating element 60 which is embedded in the lower body member 70 of the boiler. This is controlled by a separate high temperature regulator 66 which allows the boiler to reach a much higher temperature e.g. between 160° C. and 380° C.

Although not shown, one or more indicator lights or other form of indication might be provided to a user to indicate that the water system has charged, the sole plate had reached the set temperature and/or the boiler had reached its predetermined temperature. The user can then lift or move the iron away from the cordless base thereby breaking the electrical and water connections between them. The valve 20 in the cordless connector 18 on the adaptor 12 which remains on the base unit prevents the pressurized water in the umbilical cord from leaking out. A similar valve in the iron-side connector 26 prevents leakage from the pressurized system in the iron. Lifting or moving the iron away from the base also causes the microswitch 110 to open again and thereby switch off the pump unless it is configured to run continuously.

The significant thermal mass of the sole plate 4 and its element means that the temperature of the sole plate 4 remains sufficiently high for effective ironing to be carried out for a reasonable time. If the user should require steam during use of the iron, he or she simply needs to operate the knob 10 to open the valve 46 which allows water to flow into the boiler 52 as will be described below.

When the valve 46 is first opened, there will be a surge of water under pressure primarily from the surge accumulator 42. This initial surge of water rapidly fills the boiler 52 to allow steam to be generated very quickly. This is enhanced by the high thermal capacity of the boiler, particularly the lower body portion 70 which allows a significant amount of thermal energy to be stored as a result of the high temperature which the regulator 66 allows it to reach. As a result of this surge, the boiler is filled nearly to its capacity and this, with the high initial temperature of the lower body portion, produces a 'whoosh' of steam at a greater rate than the steady-state steam production rate.

Operation of the boiler module 52 will now be described in greater detail with reference to FIGS. 8 to 10. Water first enters the boiler by means of the inlet 50. The water passes through an internal conduit (not shown) in the lower body portion of the boiler 70. As the water passes through this conduit, it is preheated so that when it enters the boiling chamber its temperature is raised significantly above ambient (but below boiling). The water enters the conical boiling chamber 78 by means of an opening 82 at its apex. The water is forced under pressure, provided initially by the surge accumulator 42 and then by the on-board reservoir accumulator 36. As the water is pressurized, it is forced into the narrow gap between the stepped wall of the chamber 78 and the solid central portion 88 of the intermediate member 74. This provides an extremely efficient ratio of surface area to volume which allows a relatively large quantity of water to be evaporated into steam from a relatively small boiler volume. The shape of the evaporation space which is defined between the conical wall of the chamber 78 and the corresponding conical member 88 means that the cross sectional area of the evaporation space increases in a direction away from the inlet 82 as the water travels up the cone. This increasing volume allows for expansion of the steam created during the evaporation process and so limits the tendency for a build up in pressure to reduce the inflow rate of water. The very narrow evaporation space, the stepped form of the chamber wall and the zeolite coating which is applied to the chamber wall and the intermediate member 74 together act to mitigate the Leidenfrost effect such that this effect does not have a significant impact on the rate of evaporation.

The steam which is produced escapes from the evaporation space between the lower part of the chamber 78 and the intermediate member 74 through the series of apertures 90 formed in the latter. The pressure of this steam forces it out of the outlet pipe 84 in the top of the chamber 78. Since the outlet pipe 84 projects slightly into the chamber 78 this helps to trap any small remaining droplets of water entrained in the steam so that these fall onto the central portion 88 of the intermediate member 74 and are evaporated. The steam exiting the steam chamber 78 is superheated. The steam passes through the internal conduit 86 to the steam outlet 54 and from there into the steam pipe 56 to be vented through suitable apertures in the sole plate (not shown). Clearly, the user can regulate the rate at which steam is generated by operating the knob 10 to alter the degree of opening of the variable valve 46 and thereby alter the flow rate of water into the boiler 52.

As mentioned above, the surge accumulator 42 provides an initial surge of water to fill the evaporation space within the boiler 52 as quickly as possible to enable steam to be produced very quickly (in a matter of less than a few seconds) after the user opens the valve 46 by means of the knob 10. Thereafter, water is supplied by the on-board reservoir accumulator 36. This will continue to supply water under pressure until the on-board reservoir is no longer elastically charged. In one example, the capacity of this on-board reservoir 36 is designed to give steam at maximum rate (i.e. with the valve 46 fully open) for approximately 30 seconds. Of course, the thermal energy which can be stored in the boiler is also a relevant factor as this must be sufficient to evaporate all of the water stored in the accumulators 36, 42. Since the spring force of the piston 43 in the surge accumulator 42 is higher than the spring force of the corresponding piston 37 in the on-board reservoir accumulator 36, once the surge accumulator 42 has been emptied, it will not be refilled by the on-board reservoir accumulator 36.

Once the user has used up all the steam or the sole plate temperature has dropped too far, the iron may simply be replaced on the base unit 91 in order to replenish the accumulators 36, 42 and reheat the sole plate element and the boiler element 60 to permit the next cycle of use.

Cordless use is clearly convenient, particularly where a relatively light ironing task is being completed or where there is a relatively lower requirement for steam. However, in some circumstances it is more convenient for a user to be able to continue ironing, and in particular using steam, without having continually to replace the iron on the stand. In order to meet this objective, the adaptor 12 may simply be released from the upstand 108 of the base unit using the locking pin release knob 94 and instead clipped to the back of the iron as is shown in FIGS. 3, 4 and 11. In this mode, the on-board reservoir accumulator 36 is not required and it simply remains partly or fully charged. A microswitch in the adaptor (not shown) causes the pump in the base unit to run continuously so that the system can be maintained at the necessary pressure. The surge accumulator 42 still performs an important role in providing an additional flow of water when the valve 46 is opened to minimize the delay in production of steam. Since there is a continuous electrical and water connection, steam can be produced continuously should the user so wish. Similarly the sole plate temperature can be maintained within the range set by the temperature regulator knob 8.

Thus it will be seen by those skilled in the art that the embodiment of various aspects of the invention described above provides an extremely effective and versatile steam iron which offers the performance of a high steam pressure but which can be produced at a significantly lower cost than traditional pressurized steam generator ironing systems. Moreover, the flexibility to change between corded and cordless mode depending upon the task at hand is particularly advantageous.

Whilst the invention has been described in terms of a steam iron embodiment, many aspects and features of the invention might be applied to many different types of appliances, especially other appliances which generate steam such as steam cleaners, wallpaper strippers and other hand-held steam generating appliances. Features mentioned in connection with the embodiment described in detail above or indeed with any other embodiments mentioned herein may be applied equally to any other embodiment and to the applicant specifically envisages such combinations of features. Any feature of the invention should therefore be considered as independently applicable and not limited in its application to this specific embodiment in which it is mentioned, except where otherwise indicated.

The invention claimed is:

1. A steam generating appliance comprising a base unit and a hand-held mobile unit which can be releasably coupled to the base unit, wherein the base unit comprises;

a base reservoir for water; and a pump for pumping water from the base reservoir into the mobile unit when the mobile unit is coupled to the base unit;

and wherein the mobile unit comprises:

a boiler, and an on-board reservoir adapted to store water received from the base unit under a pressure that is greater than an ambient pressure, and to deliver the water to the boiler under the control of a user-operable valve.

2. The appliance as claimed in claim 1 comprising an electric iron.

3. The appliance as claimed in claim 2 wherein the mobile unit comprises a sole plate heated by an electric heater which is independent of the boiler.

4. The appliance as claimed in claim 1 wherein said boiler is arranged such that it is allowed to reach a higher operating temperature when there is no water flow.

5. The appliance as claimed in claim 1 wherein the on-board reservoir is elastically-charged.

6. The appliance as claimed in claim 1 wherein the on-board reservoir is acted upon by a resiliently mounted piston.

7. The appliance as claimed in claim 1 wherein the on-board reservoir has one or more expandable walls.

8. The appliance as claimed in claim 1 wherein the on-board reservoir comprises a bladder.

9. The appliance as claimed in claim 1 wherein the capacity of the on-board reservoir is sufficient to provide the water to generate steam for more than 10, 15, 20 or 30 seconds.

10. The appliance as claimed in claim 1 wherein the pump is arranged to operate continuously whilst the appliance is switched on.

11. The appliance as claimed in claim 10 comprising a mechanism for diverting pumped water back to the base reservoir when delivery of water to the mobile unit is not required.

12. The appliance as claimed in claim 1 wherein the boiler comprises a water inlet, an electric heater, a steam outlet and an evaporation space bounded by at least one surface in thermal contact with the heater, wherein the evaporation space is configured to present an expanding cross-sectional area in a direction away from the water inlet.

13. The appliance as claimed in claim 12 wherein the evaporation space has a height which is narrow enough to prevent drops from forming.

14. The appliance as claimed in claim 12 wherein the evaporation space has a constant height.

15. The appliance as claimed in claim 12 wherein the heated surface bounding the evaporation space is non-planar.

16. The appliance as claimed in claim 12 wherein a lattice or mesh structure is provided in the evaporation space.

17. The appliance as claimed in claim 1 wherein the boiler comprises an evaporation surface provided with a texture, structure or coating to increase its surface area.

18. The appliance as claimed in claim 1 wherein the boiler comprises an evaporation surface which is hydrophilic at its normal operating temperature.

19. The appliance in claim 18 wherein said normal operating temperature is greater than 160° C.

20. The appliance as claimed in claim 1 wherein the boiler comprises an evaporation surface coated with a coating comprising zeolite particulates.

21. The appliance as claimed in claim 1 wherein the boiler comprises an evaporation surface configured so as to present an interrupted flow path.

22. The appliance as claimed in claim 1 wherein the boiler comprises an arrangement for collecting steam.

23. The appliance as claimed in claim 22 wherein the arrangement for collecting steam comprises an arrangement for trapping unevaporated droplets of water.

24. The appliance as claimed in claim 1 wherein the boiler is divided into an evaporation space and a steam collection space by an intermediate member.

25. The appliance as claimed in claim 24 wherein said inteimediate member is heated.

26. The appliance as claimed in claim 1 wherein the base unit and/or the mobile unit are configured to prevent unwanted disconnection therebetween.

27. The appliance as claimed in claim 26 wherein the base unit and mobile unit comprise an arrangement for preventing separation in a direction substantially parallel to the axis of the connection, but which permit removal of the appliance in a direction non-parallel to said axis.

28. The appliance as claimed in claim 1 wherein base unit and said mobile unit have mutual cordless connector arrangements for both electrical power and water, wherein said power and water connections are provided with a mutual alignment of mating parts.

29. The appliance as claimed in claim 28 wherein said power and water connections are arranged such that after physical contact has been made between one pair of connectors and they are subsequently brought towards their full alignment axis, physical contact is made between the other pair of connectors.

30. The appliance as claimed in claim 28 wherein said power and water connectors are arranged one higher than the other when the mobile unit is on the base unit.

31. The appliance as claimed in claim 1 having mutual cordless connector arrangements for both electrical power and water, wherein said base unit is provided with a mechanism for reducing the pressure of a pressurised water supply while a user is connecting the mobile appliance to the base unit.

32. The appliance as claimed in claim 31 wherein the base unit is arranged to detect when the mobile unit is brought into engagement with it.

33. The appliance as claimed in claim 1 comprising an adaptor for supplying electrical power to the mobile unit, said adaptor being operable in a first, corded mode in which it is secured to the mobile unit to permit electrical power to be supplied while the mobile unit is being used; or in a second, cordless mode in which electrical connection between the adaptor and the mobile unit can be made by placing the mobile unit on or against the adaptor;

and broken by lifting or moving the mobile unit away from the adaptor.

34. The appliance as claimed in claim 33 wherein said adaptor is designed to be secured to the base unit or a further base unit.

35. The appliance as claimed in claim 33 wherein the adaptor is connected to the base unit.

36. The appliance as claimed in claim 33 wherein said adaptor is also arranged to supply water to the mobile unit.

* * * * *